US007672615B2

(12) United States Patent
Haruyama et al.

(10) Patent No.: US 7,672,615 B2
(45) Date of Patent: Mar. 2, 2010

(54) IMAGE FORMING APPARATUS CAPABLE OF ADJUSTING A MOVING SPEED RATIO

(75) Inventors: Daisuke Haruyama, Kanagawa (JP); Yasuhiro Oda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 287 days.

(21) Appl. No.: 11/797,338

(22) Filed: May 2, 2007

(65) Prior Publication Data

US 2008/0159761 A1 Jul. 3, 2008

(30) Foreign Application Priority Data

Dec. 27, 2006 (JP) ..... 2006-352804

(51) Int. Cl.
*G03G 15/00* (2006.01)
*G03G 15/16* (2006.01)

(52) U.S. Cl. ..... 399/167; 399/44; 399/66

(58) Field of Classification Search ..... 399/44, 399/66, 159, 167, 302, 308
See application file for complete search history.

(56) References Cited

U.S. PATENT DOCUMENTS

| | | | | |
|---|---|---|---|---|
| 6,876,371 | B2 * | 4/2005 | Suzuki et al. | 399/159 X |
| 2004/0156653 | A1 * | 8/2004 | Takehara | 399/167 |

FOREIGN PATENT DOCUMENTS

| | | |
|---|---|---|
| JP | A 47-30330 | 11/1972 |
| JP | A 4-189873 | 7/1992 |
| JP | A 4-305666 | 10/1992 |
| JP | A 5-43813 | 2/1993 |
| JP | A 5-98181 | 4/1993 |
| JP | A 5-140472 | 6/1993 |
| JP | A 5-140473 | 6/1993 |
| JP | A 5-263007 | 10/1993 |
| JP | A 5-279591 | 10/1993 |
| JP | A 8-176293 | 7/1996 |
| JP | A 8-208820 | 8/1996 |
| JP | A 2004-117722 | 4/2004 |
| JP | A 2005-266749 | 9/2005 |

* cited by examiner

*Primary Examiner*—Sandra L Brase
(74) *Attorney, Agent, or Firm*—Oliff & Berridge, PLC

(57) ABSTRACT

An image forming apparatus, includes: an intermediate transfer type image forming unit that primarily transfers a toner image formed on an electrophotographic photosensitive member to an intermediate transfer member and then secondarily transfers the toner image from the intermediate transfer member to a printing medium; and a control unit that controls a moving speed ratio ΔV represented by Expression 1 depending on a usage history of the electrophotographic photosensitive member, $$\Delta v[\%] = \frac{|v_2 - v_1|}{v_1} \times 100 \quad (1)$$

where $V_1$ is a moving speed [mm/s] of a surface of the electrophotographic photosensitive member; and $V_2$ is a moving speed [mm/s] of a surface of the intermediate transfer member in a moving direction of the surface of the electrophotographic photosensitive member, wherein the electrophotographic photosensitive member comprises a surface layer containing a curable resin on a surface facing to the intermediate transfer member.

8 Claims, 5 Drawing Sheets

IMAGE FORMING APPARATUS CAPABLE OF ADJUSTING A MOVING SPEED RATIO

CROSS-REFERENCE TO RELATED APPLICATION

This application is based on and claims priority under 35 USC 119 from Japanese Patent Application No. 2006-352804 filed Dec. 27, 2006.

BACKGROUND

1. Technical Field

The present invention relates to an image forming apparatus.

2. Related Art

In the past, as an electrophotographic image forming apparatus, there has been known an intermediate transfer type image forming apparatus which primarily transfers a toner image formed on an electrophotographic photosensitive member serving as an image carrier from the electrophotographic photosensitive member to an intermediate transfer member and then secondarily transfers the toner image from the intermediate transfer member to a printing medium.

SUMMARY

According to an aspect of the invention, there is provided an image forming apparatus, including: an intermediate transfer type image forming unit that primarily transfers a toner image formed on an electrophotographic photosensitive member to an intermediate transfer member and then secondarily transfers the toner image from the intermediate transfer member to a printing medium; and a control unit that controls a moving speed ratio ΔV represented by Expression 1 depending on a usage history of the electrophotographic photosensitive member, $$\Delta v[\%] = \frac{|v_2 - v_1|}{v_1} \times 100 \quad (1)$$

where $V_1$ is a moving speed [mm/s] of a surface of the electrophotographic photosensitive member; and $V_2$ is a moving speed [mm/s] of a surface of the intermediate transfer member in a moving direction of the surface of the electrophotographic photosensitive member, wherein the electrophotographic photosensitive member comprises a surface layer containing a curable resin on a surface facing to the intermediate transfer member.

BRIEF DESCRIPTION OF THE DRAWINGS

Exemplary embodiments of the present invention will be described in detail based on the following figures, wherein.

DETAILED DESCRIPTION

Figure 1:
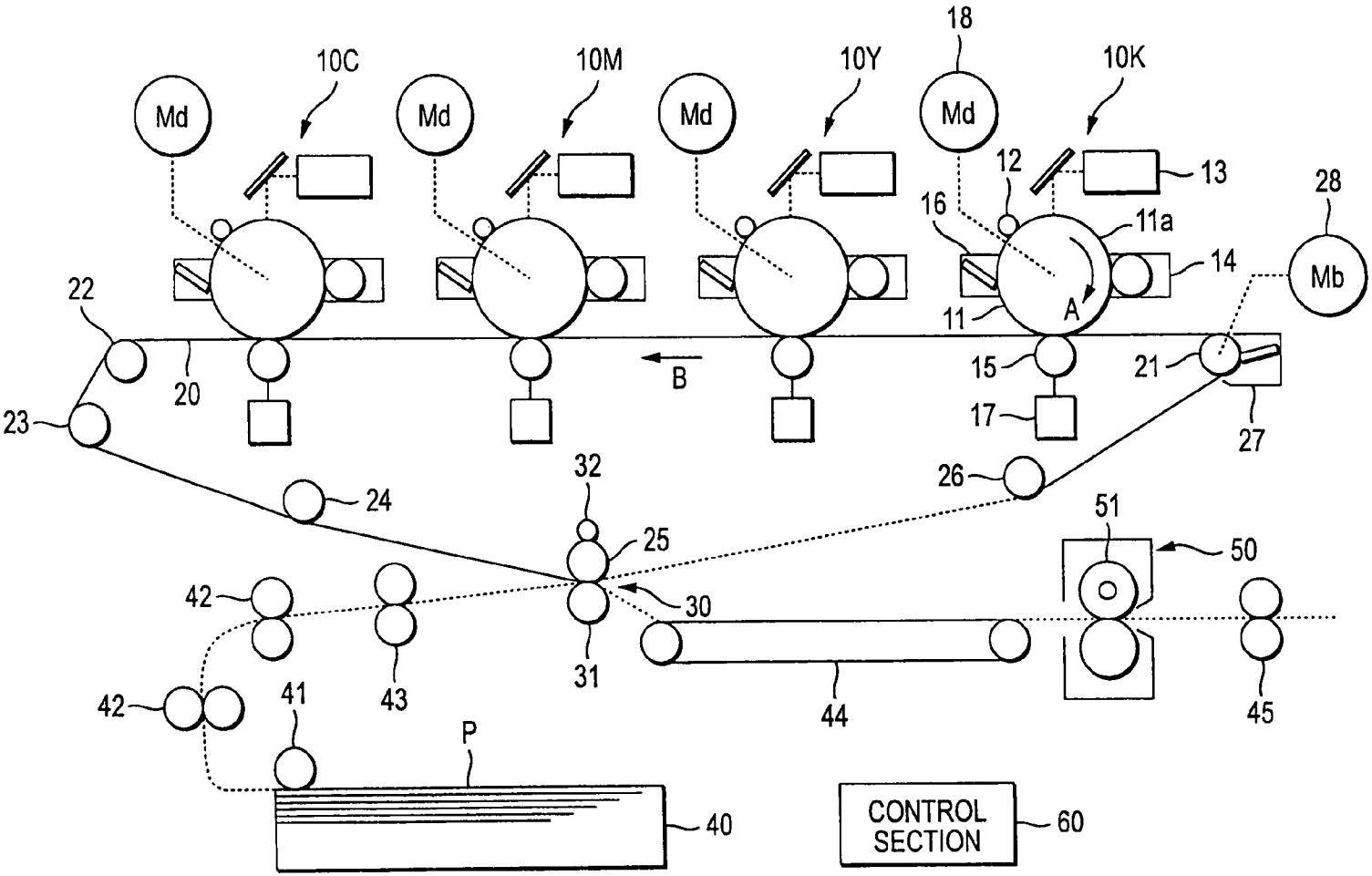
FIG. 1 illustrates a diagram schematically illustrating a preferred example of an image forming apparatus according to an aspect of the present exemplary embodiment.

Hereinafter, a preferred exemplary embodiment of the invention will be described in detail, but the invention is not limited to the following exemplary embodiment. In drawings, the same elements will be given by the same reference numerals and the repeated descriptions will be omitted.

[Image Forming Apparatus]

FIG. 1 is a diagram schematically illustrating a configuration of the image forming apparatus according to an aspect of the present exemplary embodiment. The image forming apparatus shown in FIG. 1 includes a plurality of (four in the present exemplarily embodiment) image forming units 10 (which are specifically denoted by 10K, 10Y, 10M, and 10C, but simply referred to as 'image forming units 10') for forming toner images having respective color components by electro photography; and an intermediate transfer belt 20 serving as a conveying member for sequentially transferring (primary transfer) and holding the toner images of respective color components formed by the image forming units 10. In addition, the image forming apparatus shown in FIG. 1 includes a secondary transfer device 30 for collectively transferring (secondary transfer) the overlapped images transferred on the intermediate transfer belt 20 to a paper P; and a fixing device 50 for fixing the secondarily transferred image on the paper P. Furthermore, the image forming apparatus shown in FIG. 1 includes a control section 60 for controlling an entire image forming operations.

Each one of the plurality of image forming unit 10 has an electrophotographic photosensitive member 11 which rotates in an arrow direction A shown in FIG. 1; and a charging device 12 for charging the electrophotographic photosensitive member 11 into a predetermined potential. The charging device 12 shown in FIG. 1 is a contact charging type charging device having a charging roll. In case of charging by a contact charging method, stress to the electrophotographic photosensitive member 11 is increased. However, in the image forming apparatus shown in FIG. 1, as described below, the electrophotographic photosensitive member having a protective layer 117 containing a curable resin is used. Thus, excellent durability can be obtained. Instead of the contact charging type charging device, a known non-contact charging type charging device by a corotron or a scorotron device may be used.

Each one of the plurality of image forming units 10 includes an exposing device 13 for writing an electrostatic latent image into the charged electrophotographic photosensitive member 11; and a developing device 14 for storing toners of each color components and developing the electrostatic latent image on the electrophotographic photosensitive member 11. As for the exposing device 13, there may be used an optical device which can expose a light source such as a semiconductor laser, LED (light emitting diode), and liquid crystal shutter with a desired image shape. Among these, when an exposing device capable of exposing an incoherent light is used, a fringe pattern between a supporting member and the photosensitive layer of the electrophotographic photosensitive member 11 can be prevented. As for the developing device 14, a known developing device which employs a normal or a reversal developing agent such as one component-based or two component-based developing agent may be used. In addition, the shape of the toner is not particularly limited, and for example, a toner having an amorphous shape by a grinding method or a toner having a spherical shape by a chemical polymerization method is preferably used. The usable toner can be prepared by a knead-grinding method which comprises kneading, grinding, and classifying a binding resin, a coloring agent, and a releasing agent, and a charge control agent if necessary; a method of transforming particles obtained by the knead-grinding method by a mechanical impact force or a heat energy; an emulsification polymerization and coagulation method for subjecting a polymerizable monomer of the binding resin to an emulsification polymerization, mixing thus prepared dispersion solution with a dispersion solution such as the coloring agent, the releasing agent, and the charge controlling agent if necessary, coagulating, and heat fusing the resultant such to obtain toner particles; a suspension polymerization for suspending the polymerizable monomer for obtaining the binding resin and solutions such as the coloring agent, the releasing agent, and the charge controlling agent if necessary, with an aqueous solvent and polymerizing the resultant; and a melt suspension method for suspending the binding resin and solutions such as the coloring agent, the releasing agent, and the charge controlling agent if necessary, with the aqueous solvent and granulating the resultant. Also, there may be used a preparation method of using the toner thus obtained by the aforementioned methods, and re-adhering and heat fusing the coagulated particles to give a core shall structure. From the viewpoint of the shape control and granularity distribution control, the suspension polymerization method using the aqueous solvent, the emulsification polymerization and coagulation method, and melt suspension method are preferred, and the mulsification polymerization and coagulation method is particularly preferred. A base material for toner is formed of the binding resin, the coloring agent, and there may be used the releasing agent, and silica or the charge controlling agent if necessary. An average particle diameter of the toner is 1 μm or more to 12 μm or less, and preferably 3 μm or more to 9 μm or less.

Examples of the binding resin used for the toner include homopolymers or copolymers of: styrenes such as styrene and chlorostyrene; monoolefins such as ethylene, propylene, butylene and isobutylene; vinyl esters such as vinyl acetate, vinyl propionate, vinyl benzoate and vinyl butylate; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; vinyl ethers such as vinylmethyl ether, vinylethyl ether and vinylbutyl ether; and vinyl ketones such as vinylmethyl ketone, vinylhexyl ketone and vinylisopropenyl ketone. Examples of the representative binding resins include polystyrene, styrene-acrylic ester copolymers, styrene-methacrylic ester acid copolymers, styrene-acrylonitrile copolymers, styrene-butadiene copolymers, styrene-maleic anhydride copolymers, polyethylene, polypropylene, polyester, polyurethane, epoxy resins, silicone resins, polyamide, modified rosins, paraffin and wax. A resin having a low melting point (melting point of 100° C. or less), particularly polyester resin may be used.

Examples of the representative coloring agents include magnetic powders such as magnetite and ferrite, carbon black, aniline blue, chromium yellow, ultramarine blue, DuPont oil red, quinoline yellow, methylene blue chloride, phthalocyanine blue, Malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Examples of the representative releasing agents include low molecular polyethylene, low molecular polypropylene, Fischer-Tropsch is, montan wax, carnauba wax, and rice wax, candelilla wax.

In addition, the charge controlling agents may be added in the toner if necessary. As for the charge controlling agents, known ones may be used, but there may be used a resin-type charge controlling agents containing azo-based metal complex compound, salicylate-based metal complex, and polar groups. When the toner is prepared by a wet preparation method, water insoluble material is preferably used in viewpoint of controlling ionic strength and reducing waste water pollution. In the toner of the present exemplary embodiment, there may be used any one of magnetic toners containing magnetic materials or non-magnetic toners containing no magnetic materials.

The toner may be prepared by blending the toner particles and the aforementioned external additives with the use of a Henshel-type mixer or a V-type blender. When the toner particles are prepared by wet method, the additives may be externally added.

Examples of slipping particles added in the toner include solid lubricants such as graphite, molybdenum disulfide, talc, aliphatic acid, and aliphatic metal salt; polyolefins having a low molecular weight such as polypropylene, polyethylene and polybutene; silicones which soften by heating; aliphatic acid amides such as oleic amide, erucic amide, ricinoleic amide and stearic amide; vegetable waxes such as carnauba wax, rice wax, candelilla wax, wood wax and jojoba oil; animal waxes such as beeswax; mineral/petroleum waxes such as montan wax, ozokerite, ceresin, paraffin wax, microcrystalline wax and Fischer-Tropsch wax; and modified products thereof. These may be used alone or in combination. However, the particle diameter may be selected in the range of 0.1 to 10 μm by grinding components having such a chemical structure. The slipping particles are added in the toner in the amount of 0.05 weight % to 2.0 weight %, and more preferably 0.1 weight % to 1.5 weight %.

For the purpose of removing adherents and depleted materials on the surface of the electrophotographic photosensitive member, the toner may include inorganic particles such as aluminum oxide, cerium oxide, and barium sulphate, and the cerium oxide is preferred. The average particle diameter of these inorganic particles is preferably 0.1 μm or more to 3.0 μm or less, and more preferably 0.5 μm or more to 2.0 μm or less. In case of adding the inorganic particles, it is preferable that the amount of the inorganic particles added in the toner is larger than the slipping particles, and the sum of the inorganic particles and the slipping particles is preferably 0.6 weight % or more.

By giving the inorganic particles and the slipping particles in the aforementioned preferred amount, both cleaning characteristics for the charged products and cleaning characteristics for the toner having an average shape coefficient of 100 or more to 150 or less can be achieved.

In the toner, in order to control fine particle fluidity and charging, inorganic oxides having small diameters of 40 nm of a primary diameter are used, and in order to control decrease in adhesion or charging, inorganic oxides having diameters larger than that are preferably used. As for the inorganic oxide particles, known particles are used, but silica and titanium oxide are preferably used in combination in order to precisely control the charging. In addition, by performing a surface treatment to the inorganic particles having the small diameters, dispersibility is increased and the fluidity of the fine particles is further improved.

The electrophotographic color toner may be used in combination with the carrier. Examples of the carriers include iron powder, glass beads, ferrite powder, nickel powder, and carriers of which surfaces are resin coated. In addition, the blending ratio of the color toner and the carrier may be appropriately setted.

Each one of the plurality of image forming units 10 includes a primary transfer roll 15 serving as a transfer bias applying member for transferring the toner image supported on the electrophotographic photosensitive member 11 to the intermediate transfer belt 20 serving as the conveying member; and a drum cleaner for removing residuals on the electrophotographic photosensitive member 11 after the primary transfer. In the present exemplary embodiment, the transfer member is constituted by the primary transfer roll 15 and the intermediate transfer belt 20. The drum cleaner 16 is employed in a known cleaning method such as a method which uses a cleaning blade formed from elastic materials such as rubbers to remove a developing agent such as the toner adhered to the surface of the photosensitive member by abutting one edge of the blade on the surface of an electrophotographic photosensitive member such as a photosensitive member, a blush method which uses a conductive plastic, or the like.

On the primary transfer roll 15, there is attached a roll biasing mechanism 17 to serve as a biasing unit which is formed from solenoide or the like and adjusts a biasing force to the intermediate transfer belt 20. In addition, there is provided a drum driving motor 18 for driving the electrophotographic photosensitive member 11. Such a drum driving motor 18 is constituted by a step motor which can adjust a rotation speed with high precision.

The intermediate transfer belt 20 is supported by a plurality of (which are 6 in this exemplary embodiment) supporting rolls 21 to 26. Here, the supporting roll 21 is a driving roll of the intermediate transfer belt 20. The supporting rolls 22, 23, and 26 serve as a follower roll. The supporting roll 24 serves as a correction roll for regulating a meandering operation in a direction substantially perpendicular to the conveying direction of the intermediate transfer belt 20. The supporting roll 25 is a backup roll of the secondary transfer device 30. In the intermediate transfer belt 20 having the driving roll 21 interposed therebetween, a belt cleaner 27 for removing residuals on the intermediate transfer belt 20 after the secondary transfer. The intermediate transfer belt 20 is formed by adding a predetermined amount of conductive agents such as carbon black in resins such as polyimide, polyamide, polyester, polypropylene, and polyethylene terephtalate or various rubbers. In addition, there is provided a belt driving motor 28 for driving the driving roll 21. The belt driving motor 28 is also constituted by a stepping motor which can adjust a rotation speed with high precision as well as the drum driving motor 18.

The secondary transfer device 30 includes a secondary transfer roll 31 pressed on the toner image carrying surface of the intermediate transfer belt 20; and a backup roll 25 which is disposed on a rear surface of the intermediate transfer belt 20 and forms an opposed electrode of the secondary transfer roll 31. In addition, the secondary transfer device 30 abuts on a power supplying roll 32 for applying a secondary transfer bias having a homopolarity with the charging polarity of the toner to the backup roll 25.

In addition, the paper conveying system includes a paper storing section 40 for storing the paper P serving as a sheet; a delivering roll 41 for taking out the paper P integrated in the sheet storing section 40 at a predetermined timing and then conveying the paper to the conveying path; and a conveying roll 42 for conveying the paper P wound off the delivering roll 41. At the lower portion of the paper conveying direction of the conveying roll 42, a resist roll 43 for sending the paper P to the secondary transfer device 30 at a predetermined timing is disposed. At the lower portion of the paper conveying direction lower than the secondary transfer device 30, a conveying belt 44 for conveying the paper P after the secondary transfer to a fixing device 50. At the lower portion of the sheet conveying direction lower than the fixing device 50, a discharging roll 45 for discharging the paper to a discharge storing section not shown is attached. The fixing device 50 includes a heating source therein; and a heating roll 51 disposed such to rotate. In addition, the fixing device 50 abuts on the heating roll 51 and includes a pressurizing roll 51 rotating with the heating roll 51. Here, the heating roll 51 is controlled to have a predetermined temperature range by the temperature adjusting section not shown.

Next, a fundamental image forming process of the image forming apparatus according to an aspect of the present exemplary embodiment will be described. Image data outputted from an image reading device, a personal computer, or the like is inputted to the image forming apparatus as shown in FIG. 1. After a predetermined image process is performed in the image processing device, an image forming operation is performed in the image forming apparatus by the image forming units 10. In the image processing device, a predetermined image process including various image editings such as shading correction, misaligned position correction, luminosity/color space conversion, gamma correction, frame delet, color editing, or movement editing is performed, with respect to the inputted respective data. The image data after the image process is converted into gradation data of four color materials of black (K), yellow (Y), magenta (M), and cyan (C) and outputted to the exposing device 13. The exposing device 13 exposes the exposure beam emitted from a conductive laser or the like to the electrophotographic photosensitive member 11 of each one of the image forming units 10K, 10Y, 10M, and 10C in accordance with the inputted color gradation data. In the electrophotographic photosensitive member 11 of the image forming units 10K, 10Y, 10M, and 10C, the surface thereof is charged by the charging device 12 and then the electrostatic latent image is formed by scanning and exposing the surface by using the exposing device 13. The electrostatic latent image thus formed is developed as toner images having each colors of black (K), yellow (Y), magenta (M), and cyan (C) by the developing device 14 of the each one of the image forming units 10K, 10Y, 10M, and 10C.

The toner images formed on the electrophotographic photosensitive member 11 of the image forming units 10K, 10Y, 10M, and 10C are transferred onto the intermediate transfer belt 20 by the primary transfer section abutting the electrophotographic photosensitive member 11 and the intermediate transfer belt 20. More specifically, the primary transfer section applies voltages having charging polarity and antipolarity on the base materials moving from the primary transfer roll 15 to the intermediate transfer belt 20 and performs the primary transfer by overlapping the unfixed toner images to the surface of the intermediate transfer belt 20. As described above, the primarily transferred unfixed toner images are conveyed to the secondary transfer device 30 along with the rotation of the intermediate transfer belt 20.

On the other hand, in the paper conveying system, the delivering roll 41 rotates in accordance with the image forming timing and the paper P is supplied from the paper storing section 40. The paper P supplied by the delivering roll 41 is conveyed by the conveying roll 42 and reaches the secondary transfer device 30. Before the paper reaches the secondary transfer device 30, the paper P is stopped by the resist roll 43 for the moment and the resist roll 43 rotates in accordance with the movement timing of the intermediate transfer belt 20 carrying the toner images as described above so that the position of the paper P and the positions of the toner images correspond to each other.

In the secondary transfer device 30, the secondary transfer roll 31 presses the backup roll 25 through the intermediate transfer roll 20. At this time, the paper P conveyed in accordance with the time is putted between the intermediate transfer belt 20 and the secondary transfer roll 31. When the voltage having the same polarity (negative polarity in the present exemplary embodiment) as the charging polarity of the toner is applied on the power supplying roll 32, the transfer electric field having the secondary roll 31 as the opposed electrode is formed. The unfixed toner image supported on the intermediate transfer belt 20 is electrostatically transferred on the paper P at a secondary transfer position pressed by the secondary transfer roll 31 and the backup roll 25.

After that, the paper P having the electrostatically transferred toner image is taken off the intermediate transfer belt 20 and then conveyed to the fixing device 50 by the conveying belt 44. The unfixed toner image on the paper P conveyed on the fixing device 50 is fixed on the paper P by the heat and pressure treatment performed by the fixing device 50. Then, the papers P having the fixed images are discharged to the discharge storing section not shown by the discharging roll 45. On the other hand, when the transfer process for the paper P is finished, the residual toners remained on the intermediate transfer belt 20 are conveyed to the opposed section of the belt cleaner 27 along with the rotation of the intermediate transfer belt 20 and removed from the intermediate transfer belt 20 by the belt cleaner 27.

Figure 2:
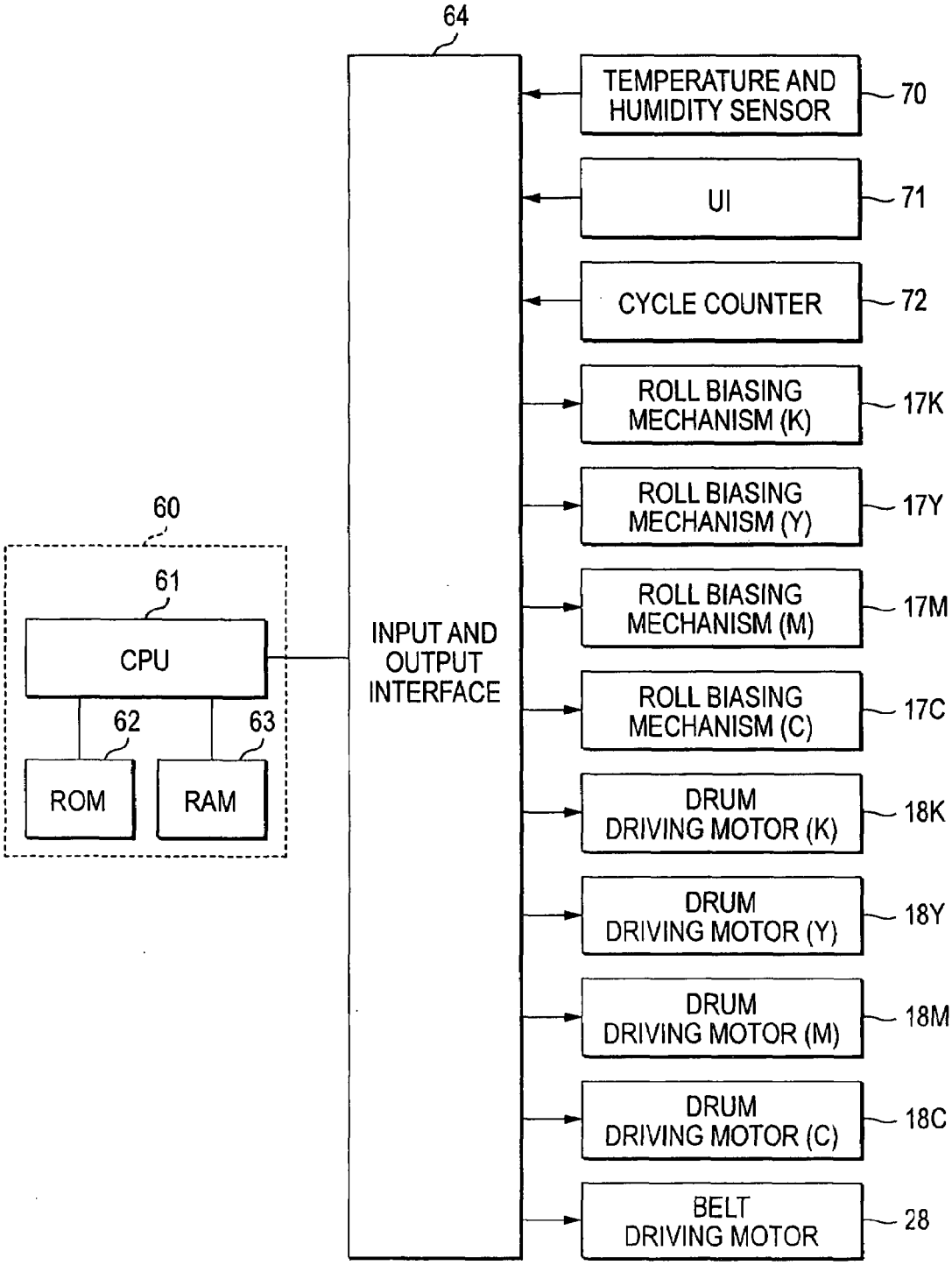
FIG. 2 illustrates a block diagram illustrating one exemplary example of a control section.

Here, a primary transfer operation in the aforementioned image forming operation will be described in detail. FIG. 2 shows one exemplary example of a function block diagram of the control section 60 serving as a speed setting unit or a biasing force setting unit. However, FIG. 2 only shows the function block relating to the primary transfer operation. A CPU 61 of the control section 60 is executed by properly exchanging data with a RAM 63 according to a program stored in a ROM 62. In the control section 60, image forming information (instructions for initiating and finishing the image forming operation) from a UI (user interface) 71 and cycle count information (number of cycles of the electrophotographic photosensitive member 11 (total number of rotations)) from a cycle counter 72 attached to the each one of the electrophotographic photosensitive member 11 of the image forming units 10 are inputted via an input and output interface 64. In the present exemplary embodiment, the number of cycles of the electrophotographic photosensitive member 11 serves as the cycle count information, but the cycle count information may be a number of the image forming in the image forming units 10 or a total number of printouts of the paper P.

In addition, the image forming apparatus of the present exemplary embodiment includes a temperature and humidity sensor 70 for detecting the temperature and the humidity at the time of the image forming. The information relating to the temperature and the humidity detected by the temperature and humidity sensor 70 is inputted to the CPU 61 via the input and output interface 64. The CPU 61 is executed by properly exchanging data with the RAM 63 according to the program previously stored in the ROM 62 on the basis of the information inputted from the temperature and humidity sensor.

The control section 60 controls the roll biasing mechanism 17 provided in each one of the primary transfer roll 15 (which is specifically 17K, 17Y, 17M, and 17C), the drum driving motor 18 provided in each one of the electrophotographic photosensitive member 11 (which is specifically 18K, 18Y, 18M, and 18C), and the belt driving motor 28 via the input and output interface 64.

In the present exemplary embodiment, the control section 60 controls a speed ratio ΔV represented by Expression 1 depending on a usage history of the electrophotographic photosensitive member 11 or in addition, the temperature and the humidity detected by the temperature and humidity sensor 70, $$\Delta v[\%] = \frac{|v_2 - v_1|}{v_1} \times 100 \tag{1}$$

where $V_1$ is a moving speed [mm/s] of the surface of the electrophotographic photosensitive member and $V_2$ is a moving speed [mm/s] of the surface of the intermediate transfer member in a moving direction of the surface of the electrophotographic photosensitive member.

Figure 3:
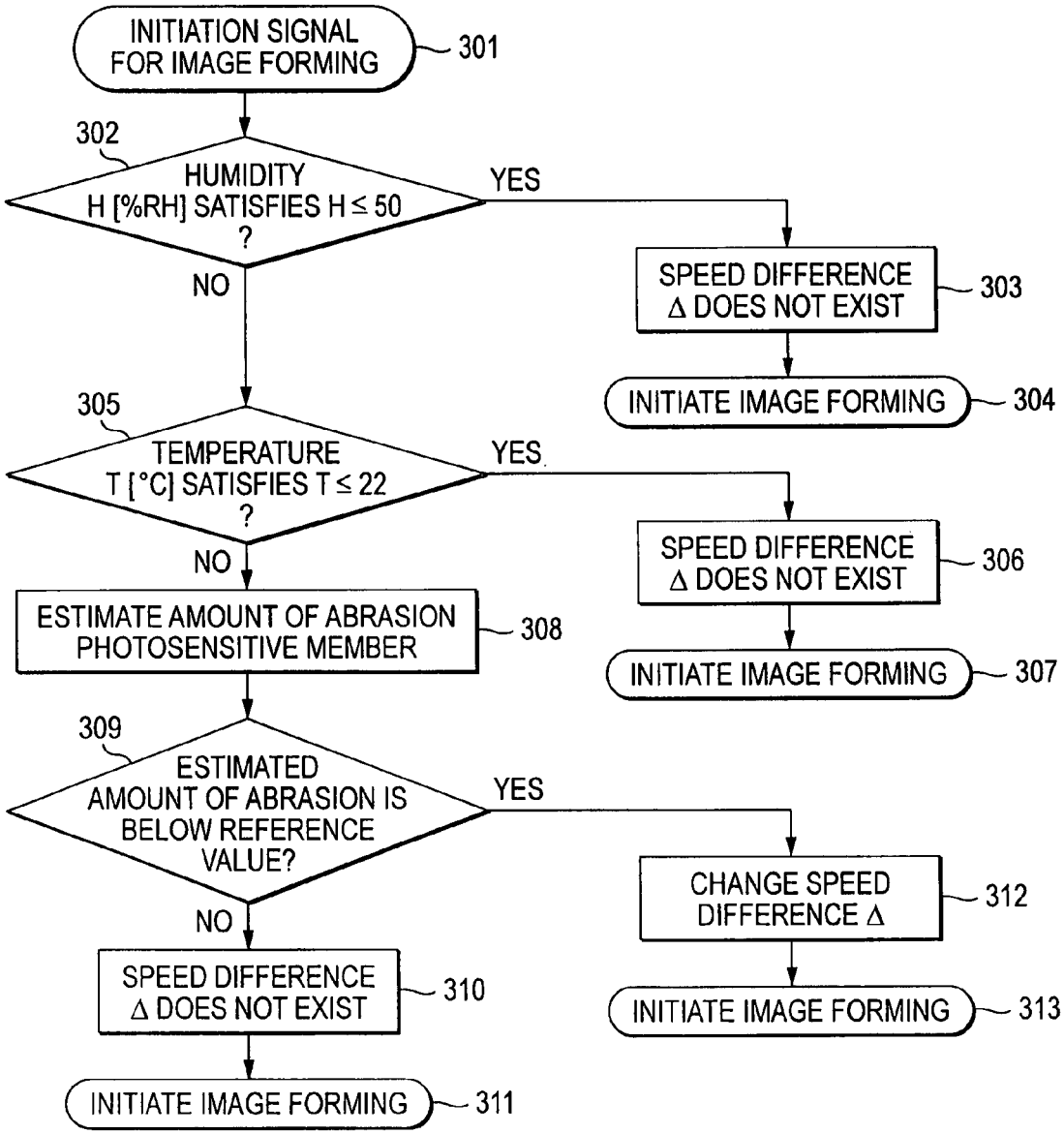
FIG. 3 illustrates a flowchart illustrating one exemplary example of a control process of a speed ratio ΔV by a control unit.

The control of the speed ratio ΔV performed by the control section 60 is carried out in orders of a flowchart shown in FIG. 3.

When an initiation signal for image forming 301 is inputted, the CPU 61 judges whether or not the humidity detected by the temperature and humidity sensor 70 is lower than a predetermined reference value (for example, 50% RH in the present exemplary embodiment) (humidity condition judging process 302). As a result, when the humidity is lower than the predetermined value, the CPU determines the moving speed ratio ΔV at that time of the image forming as 0 (303) and initiates the image forming (304) under the condition of ΔV=0. When the humidity exceeds the predetermined value, a temperature condition judging process 305 is performed. In the present exemplary embodiment, a reference value of the humidity is setted as the 50% RH. However, from the viewpoint of further preventing the deterioration in image quality such as the image fog caused by the adhesion of the discharging by-product or the like of the electrophotographic photosensitive member, it is preferable that the reference value of the humidity is in the range of 15% RH to 45% RH.

When the humidity detected by the temperature and humidity sensor 70 exceeds the previously setted reference value, the CPU 61 judges whether or not the temperature detected by the temperature and humidity sensor 70 is lower than the previously setted reference value (for example, 22° C. in the present exemplary embodiment) (temperature condition judging process (Step 305)). As a result, when the temperature is lower than the predetermined value, the CPU determines the moving speed ratio ΔV at that time of the image forming as 0 (Step 306) and initiates the image forming under the condition of ΔV=0 (Step 307). On the other hand, when the temperature exceeds the predetermined value, an abrasion amount estimating process is preformed (Step 308). In the present exemplary embodiment, the reference value of the temperature is setted as 22° C. However, from the viewpoint of further preventing the deterioration in image quality such as the image fog caused by the adhesion of the discharging by-product or the like of the electrophotographic photosensitive member, it is preferable that the reference value of the temperature is in the range of 10° C. to 20° C.

When the temperature and the humidity detected by the temperature and humidity sensor 70 each exceed the previously setted reference values, the CPU 61 estimates the total abrasion amount of the electrophotographic photosensitive member 11 (abrasion amount estimating process (Step 308))

and then judges whether or not the estimated abrasion amount is less than the previously setted reference value (abrasion amount judging process (Step 309)), on the basis of the correlation between the number of cycles (total number of rotations) previously acquired for the electrophotographic photosensitive member 11 and the abrasion amount. As a result, when the abrasion amount exceeds the predetermined value, the CPU determines the moving speed ratio ΔV at that time of the image forming as 0 (Step 310) and initiates the image forming (Step 311). On the other hand, when the abrasion amount is less than the predetermined value, the CPU determines the speed ratio ΔV as a predetermined value which is not 0 (Step 312) and initiates the image forming under the condition of ΔV>0 (Step 313). With respect to the control of ΔV, it is possible to change ΔV by controlling either one or both of $V_1$ and $V_2$. It is preferred to control preferably $V_2$, because the influence on the image formation is less. In the present exemplary embodiment, the correlation between the moving speed ratio ΔV previously acquired for the electrophotographic photosensitive member 11 and the abrasion amount is stored in the CPU 61. In addition, in the ROM, there is stored a program which selects one ΔV out of a plurality of moving speed ratio ΔVs on the basis of the correlation between the moving speed ratio ΔV and the abrasion amount. By selecting one ΔV out of a plurality of ΔVs which is the moving speed ratio ΔV, the moving speed ratio ΔV can be controlled. In the present exemplary embodiment, the reference value in the abrasion judging process in Step 309 may be one and a plurality of reference values may be provided to control a fine moving speed ratio ΔV. The abrasion estimating process (Step 308) may be performed on the basis of the correlation between the total number of the image forming and the abrasion amount, or the correlation between the total number of printout papers and the abrasion amount.

(Exemplary Embodiment of Electrophotographic Photosensitive Member)

Figure 4:
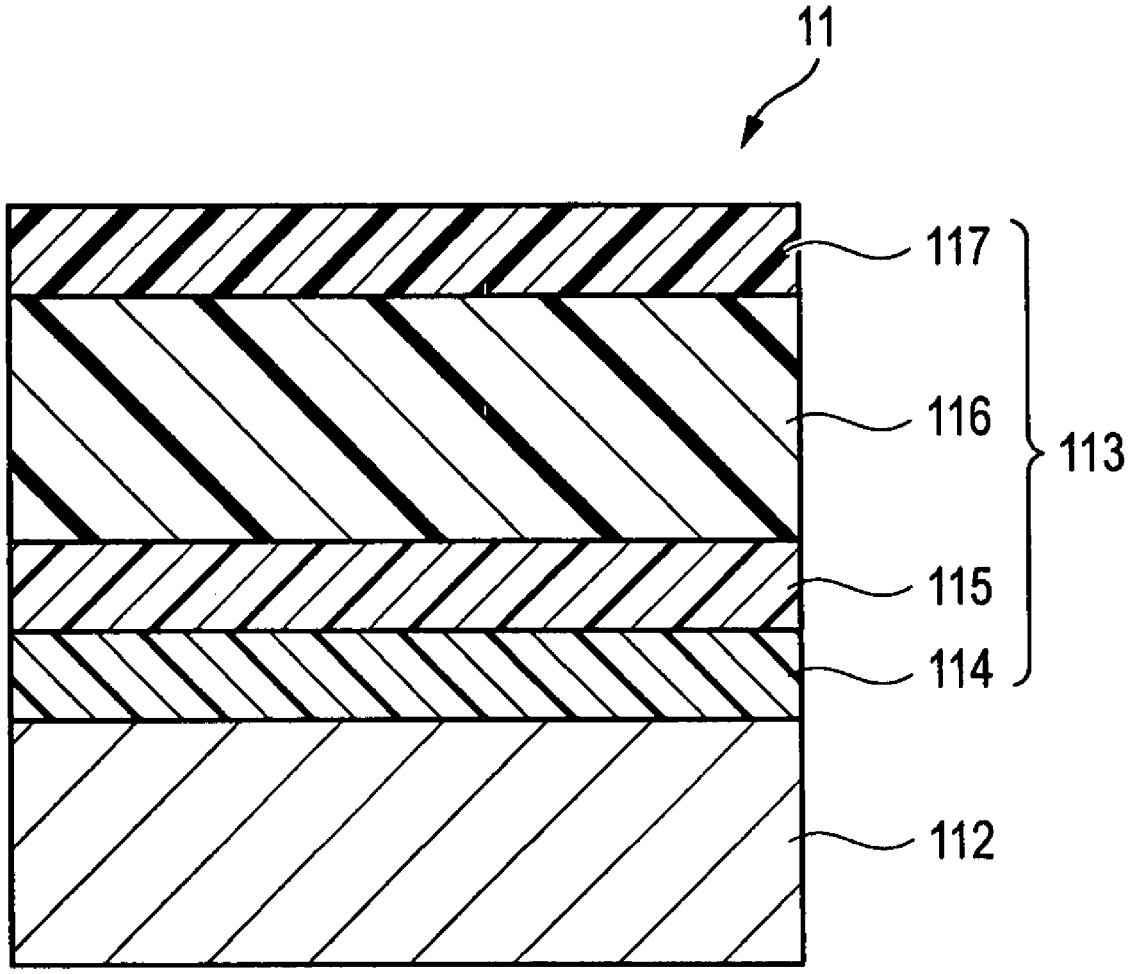
FIG. 4 illustrates a cross sectional diagram illustrating one exemplary example of an electrophotographic photosensitive member.
Figure 5:
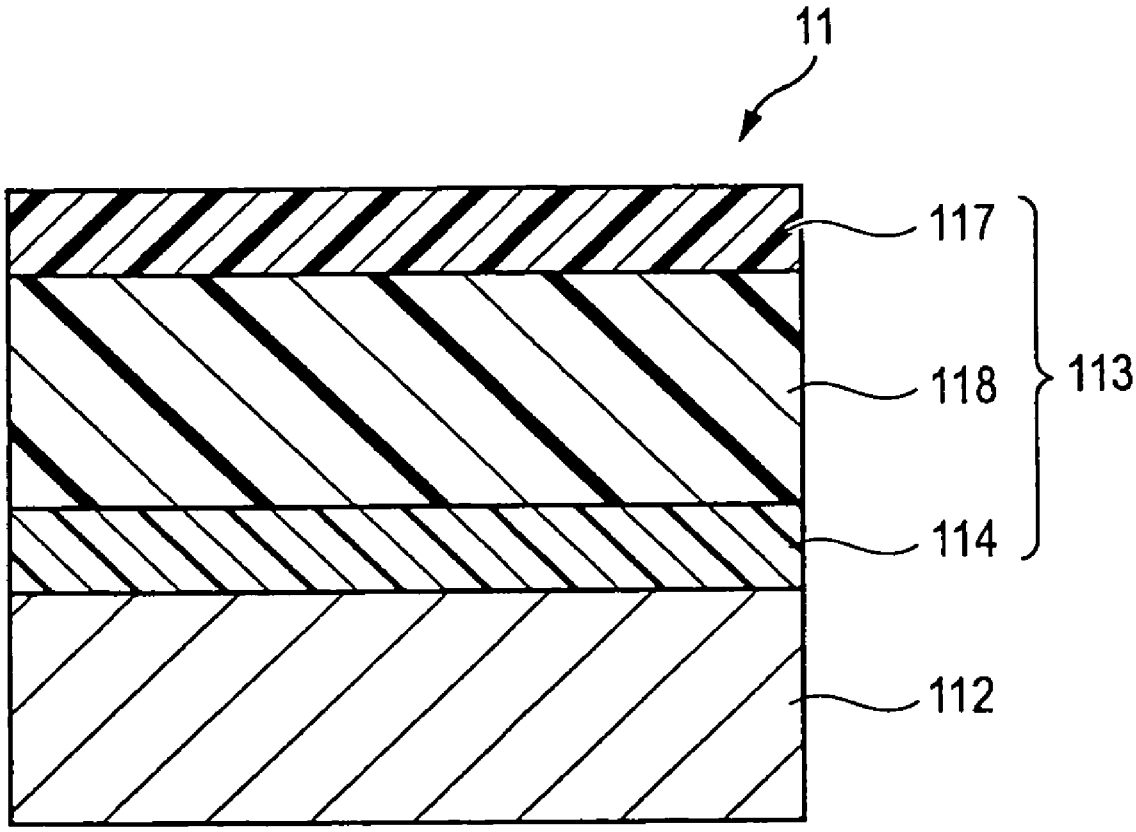
FIG. 5 illustrates a cross sectional diagram illustrating other exemplary example of an electrophotographic photosensitive member.

Next, a preferred exemplary example of the electrophotographic photosensitive member 11 will be described in detail. FIGS. 4 and 5 are cross sectional views illustrating main parts of each one of the electrophotographic photosensitive members. The electrophotographic photosensitive member shown in FIG. 4 is an electrophotographic photosensitive member (function-separated photosensitive member) having a photosensitive layer independently having an electric charge generating layer and an electric charge transporting layer. The electrophotographic photosensitive member shown in FIG. 5 is an electrophotographic photosensitive member (monolayered photosensitive member) provided with a layer containing both the electric charge generating material and the electric charge transporting material. More specifically, in the electrophotographic photosensitive member shown in FIG. 4, there is provided an undercoat layer 114; an electric charge generating layer 115; an electric charge transporting layer 116; and a protective layer 117 in this order on a conductive support member 112 such to constitute the photosensitive layer 113. In the electrophotographic photosensitive member shown in FIG. 5, there is provided the undercoat layer 114; an electric charge generating/transporting layer 118; and a protective layer 117 in this order on the conductive support member 112 such to constitute the photosensitive layer 113.

Examples of the conductive support member 112 include a metal plate, a metal drum or a metal belt using a metal such as aluminum, copper, zinc, stainless steel, chromium, nickel, molybdenum, vanadium, indium, gold or platinum, or an alloy thereof; and a paper, a plastic film or a belt which is coated, deposited or laminated with a conductive polymer, a conductive compound such as indium oxide, a metal such as aluminum, palladium, or gold, or an alloy thereof. When the photosensitive drum is used in a laser printer, the oscillation wavelength of the laser beam is preferably from 350 to 850 nm. The laser beam having a shorter wavelength is preferred because of its excellent resolution. Further, since a friction coefficient between the blade cleaner and the transfer belt can be decreased by using the photosensitive member of the present exemplary embodiment, the rotation of the photosensitive member becomes smooth and the deterioration in image quality such as banding can be prevented. In addition, the load relating to the driving motor such as the photosensitive member can be reduced and an effect for achieving low power consumption can be achieved. In order to prevent interference fringes generated in laser beam irradiation, it is preferred that a surface of the support member is roughened to a center line average roughness (Ra) of 0.04 to 0.5 μm. As a method of roughening the surface, preferred is a wet honing conducted by suspending an abradant in water and spraying the solution to the support member, a centerless grinding in which the supporting member is pressed on a rotating grind stone to conduct grinding treatment continuously, or an anodization. When Ra is less than 0.04 μm, an effect for preventing the interference can not be obtained, because the surface approaches a mirror surface. On the other hand, when Ra exceeds 0.5 μm, the image quality tends to become rough even in the case where a coating according to an aspect of the present exemplary embodiment is formed on the support member, and thus it is not preferable. Furthermore, in order to maintain high image quality, the undercoat layer is preferably provided. This undercoat layer prevents the photosensitive layer from being charged by the conductive support member 11 at the time of charging the photosensitive layer 12 having a laminated structure and serves as an adhesion layer for integrally adhering the photosensitive layer to the conductive support member, or it prevents the reflection of the light of the conductive support member, if necessary. When noninterference light serves as a light source, the surface roughening for the prevention of interference fringes is not particularly required and the occurrence of defects caused by unevenness of the base material can be prevented. Accordingly, this is suitable for the prolongation of the lifetime.

In the anodization treatment, anodization is conducted in an electrolytic solution using aluminum as an anode, thereby forming an oxide film on a surface of aluminum. Examples of the electrolytic solution include a sulfuric acid solution and an oxalic acid solution. However, the porous anodized film itself is chemically active, easily soiled, and large in resistance variations. Consequently, fine pores of the anodized film are sealed by volume expansion by hydration reaction in pressurized water vapor or boiling water (metal salts such as nickel salt may be added) to conduct sealing treatment for converting the film to a more stable hydrated oxide.

The film thickness of the anodized film is preferably in the range of 0.3 μm to 15 μm. When the film thickness is less than 0.3 μm, barrier properties to injection are poor, and the effect is not sufficient. On the other hand, when the thickness exceeds 15 μm, an increase in residual potential by repeated use is caused.

Further, it is also possible to treat the substrate with an acidic treating solution comprising phosphoric acid, chromic acid, and hydrofluoric acid, and the treatment is conducted in the following manner. The mixing ratio of phosphoric acid, chromic acid, and hydrofluoric acid in the acidic treating solution, phosphoric acid is in the range of 10 weight % to 11 weight %, chromic acid is in the range of 3 weight % to 5 weight %, and hydrofluoric acid is in the range of 0.5 weight % to 2 weight %. The total concentration of these acids is preferably from 13.5 weight % to 18 weight %. Although the treating temperature is in the range of 42° C. to 48° C., the thicker coating can be formed more rapidly by keeping the treating temperature high. The film thickness of the coating is preferably in the range 0.3 to 15 μm. When the film thickness is less than 0.3 μm, barrier properties to injection are poor, and the effect is not sufficient. On the other hand, when the thickness exceeds 15 μm, an increase in residual potential by repeated use is caused.

Boehmite treatment can be conducted by immersing the support member in pure water of 90 to 100° C. for 5 to 60 minutes or by bringing the support member into contact with heated water vapor of 90 to 120° C. for 5 to 60 minutes. The film thickness of the coating is preferably from 0.1 to 5 μm. This may be further anodized using an electrolytic solution low in film solubility, such as a solution of adipic acid, boric acid, a borate, a phosphate, a phthalate, a maleate, a benzoate, a tartrate or a citrate.

Examples of the materials used for the undercoat layer 114 include organozirconium compounds such as zirconium chelate compounds, zirconium alkoxide compounds, and zirconium coupling agents; organotitanium compounds such as titanium chelate compounds, titanium alkoxide compounds, and titanate coupling agents; organoaluminum compounds such as aluminum chelate compounds and aluminum coupling agents; and other organometallic compounds such as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicon alkoxide compounds, aluminum titanium alkoxide compounds, and aluminum zirconium alkoxide compounds. The organozirconium compounds, organotitanyl compounds, and organoaluminum compounds, in particular, are preferred, because they have low residual potentials and exhibit satisfactory electrophotographic properties. In addition, examples of silane coupling agent include vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylpropyltrimethoxysilane, γ-mercaptopropyltrimethoxysilane, γ-ureidopropyltriethoxysilane, and β-3,4-epoxycyclohexylethyltrimethoxysilane. Further, there can also be used known binding resins such as polyvinyl alcohol, polyvinyl methyl ether, poly-N-vinylimidazole, polyethylene oxide, ethyl cellulose, methyl cellulose, an ethylene-acrylic acid copolymer, a polyamide, a polyimide, casein, gelatin, polyethylene, a polyester, a phenol resin, a vinyl chloride-vinyl acetate resin, an epoxy resin, polyvinylpyrrolidone, polyvinylpyridine, a polyurethane, polyglutamic acid, and polyacrylic acid, which have been used in the conventional undercoating layers. The blending ratio thereof can be properly selected if necessary. The electron transferring pigments may be blended/dispersed in the undercoat layer. As for the electron transfer pigments, there may be used organic pigments such as the perylene pigment, the bisbenzimidazole perylene pigment, the polycyclic quinone pigment, the indigo pigment, and the quinacridone pigment, which are described in JP-A-47-30330; organic pigments such as a bisazo pigment having an electron attractive substituent group such as a cyano group, a nitro group, a nitroso group, or a halogen atom and a phthalocyanine pigment; and inorganic pigments such as zinc oxide and titanium oxide. Among these pigments, the perylene pigment, the bisbenzimidazole perylene pigment, the polycyclic quinone pigment, zinc oxide, and titanium oxide are preferably used because of their high electron mobility. In order to control dispersibility and electron transfer property, these pigments may be surface treated with the silane coupling agent, a binder or the like. When the electron transfer pigment is too much, the strength of the undercoat layer tends to decrease and causes coating defects. It is therefore used preferably in an amount of 95 weight % or less, and more preferably in an amount of 90 weight % or less. A conventional method using a ball mill, a roll mill, a sand mill, an attriter, an ultrasonic wave or the like is applied to the mixing/dispersing. The mixing/dispersing is conducted in an organic solvent, and as the organic solvent, any solvent can be used as long as it dissolves the organic metal compound or the resin, and does not cause gelation or coagulation when the electron transfer pigment is mixed/dispersed. The solvents include, for example, known organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. They can be used alone or as a mixture of two or more of them. The film thickness of the undercoat layer 114 is preferably in the range of 0.1 to 30 μm, and more preferably from 0.2 to 25 μm. As a coating method, a normally used method such as blade coating, Mayer bar coating, spray coating, dip coating, bead coating, air knife coating, or curtain coating can be employed. The undercoat layer 114 is obtained by drying the coating. Normally, the drying process is performed under the temperature which can evaporate the solvent and form a film. Particularly, the base material subjected to an acid solution treatment or the Boehmite treatment tends to exhibit insufficient defect coverage properties, and thus it is preferred to form the under coat layer 114.

Next, the electric charge generating layer 115 will be described. As for the charge generation material, there may be used known materials which can be exemplified by organic pigments, such as azo pigments including bisazo, trisazo, or the like, condensed ring aromatic pigments including dibromo anthanthrone or the like, a perylene pigment, a pyrrolopyrrole pigment, and a phthalocyanine pigment; inorganic pigments, such as trigonal selenium and zinc oxide; and the like. Particularly, in case of using an exposure wavelength of 380 to 500 nm, the inorganic pigments are preferred, and in case of using an exposure wavelength of 700 nm to 800 nm, a metal or metal-free phthalocyanine pigment is preferred. Among these, hydroxy gallium phthalocyanines disclosed in JP-A-05-263007 and JP-A-05-279591, chloro gallium phthalocyanines disclosed in JP-A-05-98181, dichlorotin phthalocyanines disclosed in JP-A-05-140472 and JP-A-05-140473, and titanyl phthalocyanines disclosed in JP-A-04-189873 and JP-A-05-43813 are particularly preferable.

The binding resin used for the electric charge generating layer 115 can be selected from a wide range of insulating resins, and it can be also selected from organic photoconducting polymers, such as poly-N-vinylcarbazole, polyvinylanthracene, polyvinylpyrene, polysilane, and the like. Preferred examples of the binding resin include insulating resins, such as polyvinyl butyral resin, polyarylate resin (such as, a polycondensate of bisphenol A and phthalic acid), polycarbonate resin, polyester resin, phenoxy resin, a vinyl chloride-vinyl acetate copolymer, polyamide resin, acrylic resin, polyacrylamide resin, polyvinylpyridine resin, cellulose resin, urethane resin, epoxy resin, casein, polyvinyl alcohol resin, polyvinylpyrrolidone resin, and the like, but the examples are not limited thereto. These binding resins can be used alone or in combination of two or more.

The blending ratio (weight ratio) of the electric charge generating material to the binding resin is preferably in the range 10:1 to 1:10. Examples of a method for dispersing each of the above-described constituent materials include known methods, such as a ball mill dispersion method, an attritor dispersion method, a sand mill dispersion method, and the like. In this case, conditions under which the crystal form of a pigment is not changed by dispersion are required. Further, it is confirmed that the crystal form is not changed as compared to before the dispersion in all dispersion methods described-above conducted in the present exemplary embodiment. In addition, for the dispersion, it is effective to use a particle having a size of preferably 0.5 μm or less, more preferably 0.3 μm or less, and further preferably 0.15 μm or less. Examples of the solvent used for dispersion include known organic solvents, such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorbenzene, toluene, and the like. These can be used alone or in combination of two or more. The thickness of the charge generating layer is generally 0.1 to 5 μm, and preferably 0.2 to 2 μm. Examples of a coating method which is used when forming the charge generating layer include known methods, such as a blade coating method, a Mayer bar coating method, a spray coating method, a dip coating method, a bead coating method, an air knife coating method, a curtain coating method, and the like.

Consequently, the charge transporting layer 116 will be described. The charge transporting layer 116 contains a charge transporting material and a binding resin, or contains a high molecular charge transporting material.

Examples of the charge transporting material include electron transporting compounds, such as quinine-based compounds including p-benzoquinone, chloranil, bromanil, anthraquinone, or the like, tetracyanoquinodimethane-based compounds, fluorenone compounds including 2,4,7-trinitrofluorenone or the like, xanthone-based compounds, benzophenone-based compounds, cyanovinyl-based compounds, ethylene-based compounds, and the like; and hole transporting compounds, such as triarylamine-based compounds, benzidine-based compounds, arylalkane-based compounds, aryl-substituted ethylene-based compounds, stilbene-based compounds, anthracene-based compounds, hydrazine-based compounds, and the like, but the examples are not particularly limited thereto. These charge transport materials can be used alone or in combination of two or more.

Also, from the viewpoint of charge mobility, the charge transporting material is preferably a compound represented by the following formula (a-1), (a-2) or (a-3).

(a-1)

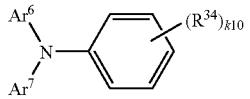

In the formula (a-1), $R^{34}$ represents a hydrogen atom or a methyl group, and k10 represents 1 or 2. Also, $Ar^6$ and $Ar^7$ denote a substituted or unsubstituted aryl group, $—C_6H_4—C(R^{38})=C(R^{39})(R^{40})$ or $—C_6H_4—CH=CH—CH=C(Ar)_2$, and examples of the substituent group include a halogen atom, an alkyl group having 1 to 5 carbon atoms, an alkoxy group having 1 to 5 carbon atoms, or substituted amino groups substituted with an alkyl group having 1 to 3 carbon atoms. Also, $R^{38}$, $R^{39}$, and $R^{40}$ denote a hydrogen atom, a substituted or unsubstituted alkyl group, or a substituted or unsubstituted aryl group, and Ar represents a substituted or unsubstituted aryl group.

(a-2)

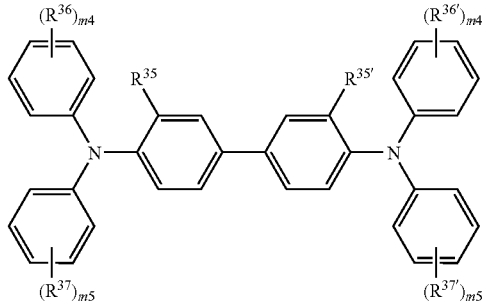

In the formula (a-2), $R^{35}$ and $R^{35'}$ each individually represents a hydrogen atom, a halogen atom, an alkyl group having 1 to 5 carbon atoms, or an alkoxy group having 1 to 5 carbon atoms, $R^{36}$, $R^{36'}$, $R^{37}$, and $R^{37'}$ each individually represents a halogen atom, an alkyl group having 1 to 5 carbon atoms, an alkoxy group having 1 to 5 carbon atoms, an amino group substituted with an alkyl group having 1 to 2 carbon atoms, a substituted or unsubstituted aryl group, $—C(R^{38})=C(R^{39})(R^{40})$, or $—CH=CH—CH=C(Ar)_2$, $R^{38}$, $R^{39}$, and $R^{40}$ each individually represents a hydrogen atom, a substituted or unsubstituted alkyl group, or a substituted or unsubstituted aryl group, and Ar represents a substituted or unsubstituted aryl group. Also, m4 and m5 each individually represents an integer of from 0 to 2.

(a-3)

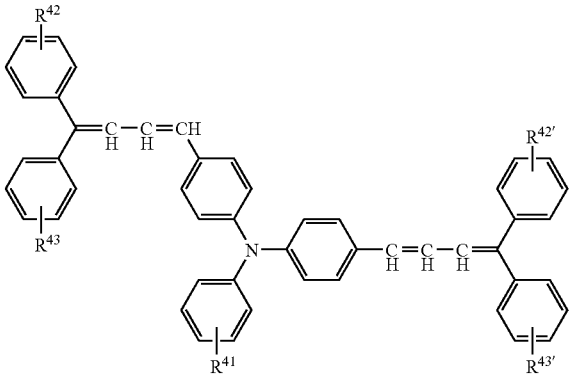

Here, in the formula (a-3), $R^{41}$ represents a hydrogen atom, an alkyl group having 1 to 5 carbon atoms, an alkoxy group having 1 to 5 carbon atoms, a substituted or unsubstituted aryl group, or $—CH=CH—CH=C(Ar)_2$. Ar represents a substituted or unsubstituted aryl group. $R^{42}$, $R^{42'}$, $R^{43}$, and $R^{43'}$ each individually represents a hydrogen atom, a halogen atom, an alkyl group having 1 to 5 carbon atoms, an alkoxy group having 1 to 5 carbon atoms, an amino group substituted with an alkyl group having 1 to 2 carbon atoms, or a substituted or unsubstituted aryl group.

Examples of the binding resin used for the electric charge transporting layer 116 include a polycarbonate resin, a polyester resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrenealkyd resin, and the like. These binding resins can be used alone or in combination of two or more. The blending ratio (weight ratio) between the electric charge transporting material and the binding resin is preferably 10:1 to 1:5.

Also, as a high molecular charge transporting material, a known charge transporting material, such as poly-N-vinylcarbazole, polysilane, or the like, can be used. For example, polyester-based high molecular charge transport materials disclosed in JP-A-08-176293 and JP-A-08-208820 are particularly preferable because of their high charge transporting ability. The high molecular charge transporting material can be used alone as a constituent material of the charge transporting layer 116, but can be used in combination with the binding resin for film formation.

The charge transport layer 116 can be formed by coating a coating liquid which contains the above-described constituent material on the electric charge generating layer 115 and drying the resultant. Examples of a solvent for the coating liquid for forming the electric charge transporting layer include known organic solvents, such as aromatic hydrocarbons including benzene, toluene, xylene, chlorobenzene, or the like, ketones including acetone, 2-butanone, or the like, halogenated aliphatic hydrocarbons including methylene chloride, chloroform, ethylene chloride, or the like, and cyclic or straight-chained ethers including tetrahydrofuran, ethyl ether, or the like. These can be used alone or in combination of two or more. Examples of a coating method which is used for the coating liquid for forming the electric charge transporting layer include known methods, such as a blade coating method, a wire bar coating method, a spray coating method, a dip coating method, a bead coating method, an air knife coating method, a curtain coating method, and the like. The thickness of the charge transporting layer 116 is preferably in the range of 5 to 50 μm, and more preferably in the range of 10 to 30 μm.

The electric charge transporting layer 116 constituting the photosensitive layer 113 may be added with an additive, such as an antioxidant, a light stabilizer, a thermal stabilizer, or the like, for the purpose of preventing the photosensitive member from being deteriorated due to ozone or oxidized gas generated at the time of image forming or due to light or heat. Examples of the antioxidant include hindered phenol, hindered amine, paraphenylendiamine, arylalkane, hydroquinone, spirochroman, spiroindanone, derivatives thereof, organic sulfur compounds, organic phosphorus compounds, and the like. Examples of the light stabilizer include derivatives of benzophenone, benzotriazole, dithiocarbamate, tetramethylpiperidine, and the like.

Also, the photosensitive layer 3 can contain at least one electron accepting substance for the purpose of achieving an improvement in sensitivity, a reduction in residual potential, a reduction in fatigue during repetitive use, and the like.

Examples of the electron accepting substance include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the like. Among these, fluorenones, quinines, and benzene derivatives having an electron attractive substituent group, such as Cl, CN, $NO_2$, or the like, are particularly preferable.

The protective layer 117 includes a curable material of a curable resin as described above.

As for the curable resin, a curable resin soluble in alcohol is preferred. The term of 'curable resin soluble in alcohol' used in the present exemplary embodiment means the curable resin 1% by weight of which can be dissolved in at least one alcohol selected from alcohols having 5 or less of carbon atoms. Preferred examples of the curable resin soluble in the alcohol include heat curable resin such as a phenol resin, a heat curable acryl resin, a heat curable silicon resin, an epoxy resin, a melanine resin, and a urethane resin. The phenol resin, melanine resin, siloxane resin, and the urethane resin are particularly preferred. Among these curable resins, the phenol resin is preferred in the viewpoint of the mechanical strength, electric characteristics, and adhesion removing ability.

The phenolic resin can be obtained by reacting a compound having a phenolic structure such as substituted phenols containing one hydroxyl group including resorcin, bisphenols, phenol, crezole, xylenol, para alkylphenol, para phenylphenol, or the like, substituted phenols including two hydroxyl groups such as catechol, resorcinol, hydroquinone, or the like, bisphenols such as bisphenol A, bisphenol Z, or the like, bidphelos with formaldehyde or para formaldehyde in the presence of a catalyst such as acid or alkali. As the phenolic resin, monomers of monomethylol phenols, dimethylol phenols, and trimethylol phenols, mixtures thereof, or oligomers thereof, and mixtures of the monomers and oligomers, can be used. Among these, relatively large molecules having repeated structural units of 2 to 20 are the oligomers and the molecules having the repeated structural units lower than that are monomers.

Examples of the acid catalyst used here are sulfuric acid, paratoluenesulfonic acid, phenolsulfonic acid, and phosphoric acid. Examples of the alkali catalyst include hydroxides and oxides of alkali metals and alkaline earth metals such as NaOH, KOH, $Ca(OH)_2$, $Mg(OH)_2$, $Ba(OH)_2$, CaO, MgO, or the like; and acetate salts such as amine-based catalysts, zinc acetate, sodium acetate, or the like.

Here, examples of the amine-based catalysts include ammonia, hexamethylenetetramine, trimethylamine, triethylamine, triethanolamine, and the like.

When basic catalysts are used, a significant number of carriers may be trapped by the remained catalyst, leading to deterioration in electrophotographic characteristics. In such a case, the catalyst is preferably distilled off under reduced pressure, neutralized, or inactivated or removed by contact with an absorbent such as silica gel, ion exchange resin, or the like. Also, a curing catalyst can be used to cure the above-described phenolic resin. The curing catalyst is not particularly limited as long as electrical characteristics and the like are not affected.

The protective layer 117 preferably further contains a conductive inorganic particle and/or an electric charge transporting organic compound for the purpose of enhancing the electrical characteristics.

As the conductive inorganic particles, metal, metal oxide, carbon black, or the like is preferably used. Examples of the metal include aluminum, zinc, copper, chromium, nickel, silver, stainless steel, and the like; or plastics having these metals deposited on the surface of the plastic particle, and the like. Examples of the metal oxide include zinc oxide, titanium oxide, tin oxide, antimony oxide, indium oxide, bismuth oxide, indium oxide doped with tin, tin oxide doped with antimony or tantalum, zirconium oxide doped with antimony, and the like. These can be used alone or in combination of two or more. In the case of using them in combination of two or more, they may be simply mixed together or used in the form of solid solution or fusion. From the viewpoint of transparency of the protective layer, the average particle diameter of the conductive particle is preferably 0.3 μm or less, and more preferably 0.1 μm or less. Also, among the above-described conductive inorganic particles, the metal oxides are particularly preferable in the viewpoint of the transparency. Also, in order to control dispersibility, it is preferable to surface-treat the fine particle. Examples of a treatment agent include a silane coupling agent, a silicon oil, a siloxane compound, a surfactant, and the like. These treatment agents preferably contain a fluorine atom.

It is preferable that the electric charge transporting organic compound is used together with the curable resin employable herein, and it is further preferable that it forms a chemical bonding with the carable resin employable herein.

As the electric charge transporting organic compound having a reactive functional group, a compound represented by the following formulas (I), (II), (III), (IV), (V), and (VI) is preferred because of its excellent film formability, mechanical strength, and stability.

$$F—[(X^1)_{n1}R^1—Z^1H]_{m1} \quad (I)$$

[in the formula (I), F represents an organic group derived from a compound having electron hole transporting properties, $R^1$ represents an alkylene group, $Z^1$ represents an oxygen atom, a sulfur atom, NH, or COO, $X^1$ represents an oxygen atom or a sulfur atom, m1 represents an integer in the range of 1 to 4, and n1 represents 0 or 1.]

$$F—[(X^2)_{n2}—(R^2)_{n3}—(Z^2)_{n4}G]_{n5} \quad (II)$$

[in the formula (II), F represents an organic group derived from a compound having electron hole transporting properties, $X^2$ represents an oxygen atom or a sulfur atom, $R^2$ represents an alkylene group, $Z^2$ represents an oxygen atom, a sulfur atom, NH, or COO, G represents an epoxy group, n2, n3, and n4 independently represents 0 or 1, and n5 represents an integer in the range of 1 to 4.]

$$F[\text{-}D\text{-}Si(R^3)_{(3-a)}Q_a]_b \quad (III)$$

[in the formula (III), F represents an organic group having a b-valancy derived from a compound having electron hole transporting properties, D represents a divalent group, $R^3$ represents an hydrogen atom, substituted or unsubstituted alkyl group or substituted or unsubstituted aryl group, Q represents a hydrolytic group, a represents an integer in the range of 1 to 3, and b represents an integer in the range of 1 to 4.]

(IV)

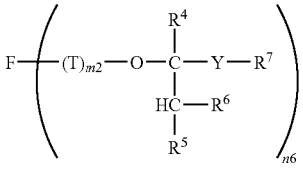

[in the formula (IV), F represents an organic group derived from a compound having electron hole transporting properties, T represents a divalent group, Y represents an oxygen atom or a sulfur atom, $R^4$, $R^5$, and $R^6$ each independently represents an hydrogen atom or monovalent organic group, $R^7$ represents a monovalent organic group, m2 represents 0 or 1, and n6 represents an integer in the range of 1 to 4. Here, $R^6$ and $R^7$ may be bonded to form a heterocycle having Y as a hetero atom.]

(V)

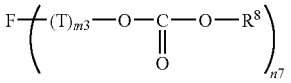

[in the formula (V), F represents an organic group derived from a compound having electron hole transporting properties, T represents a divalent group, $R^8$ represents a monovalent organic group, m3 represents 0 or 1, and n7 represents an integer in the range of 1 to 4.]

(VI)

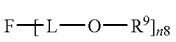

[in the formula (VI), F represents an organic group derived from a compound having electron hole transporting properties, L represents an alkylene group, $R^9$ represents a monovalent organic group, and n8 represents an integer in the range of 1 to 4.]

In addition, the F in the compound represented by Formulas (I) to (VI) is preferably a group represented by Formula (VII).

(VII)

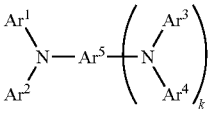

[in the formula (VII), $Ar^1$, $Ar^2$, $Ar^3$, and $Ar^4$ each independently represents a substituted or unsubstituted aryl group, $Ar^5$ represents a substituted or unsubstituted aryl group or a substituted or unsubstituted arylene group, and 1 to 4 among $Ar^1$ to $Ar^5$ includes bonds bondable to a portion represented by Formula (VII) in the compound represented by Formula (I), a portion represented by Formula (IX) in the compound represented by Formula (II), a portion represented by Formula (X) in the compound represented by Formula (III), a portion represented by Formula (XI) in the compound represented by Formula (IV), a portion represented by Formula (XII) in the compound represented by Formula (V), or a portion represented by Formula (XIII) in the compound represented by Formula (VI).]

(VIII)

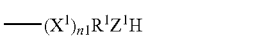

(IX)

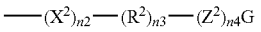

(X)

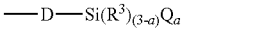

(XI)

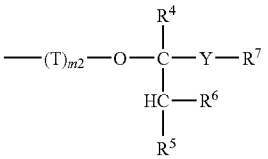

(XII)

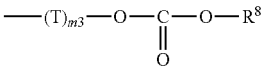

(XIII)

Specifically, the substituted or unsubstituted aryl group denoted by $Ar^1$ to $Ar^4$ is preferably the aryl group represented by Formulas (1) to (7).

TABLE 1

| | |
|---|---|
| 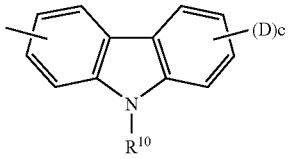 | (1) |
| 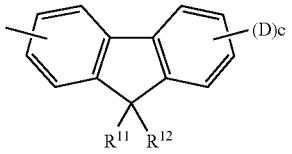 | (2) |
| 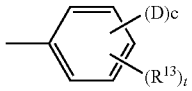 | (3) |
| 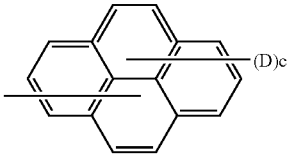 | (4) |
| 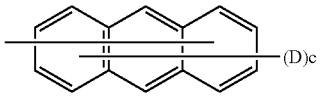 | (5) |
| 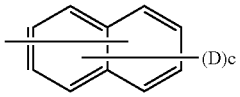 | (6) |
| —Ar—(Z')s—Ar—(D)c | (7) |

In Formulas (1) to (7), $R^{10}$ represents a hydrogen atom, an alkyl group having 1 to 4 carbon atoms, an alkyl group having 1 to 4 carbon atoms, an alkoxy group having 1 to 4 carbon atoms, a phenyl group substituted or unsubstituted therewith, or an aralkyl group having 7 to 10 carbon atoms, $R^{11}$ to $R^{13}$ each represents a hydrogen atom, an alkyl group having 1 to 4 carbon atoms, an alkoxy group having 1 to 4 carbon atoms, an alkoxy group having 1 to 4 carbon atoms, a phenyl group substituted or unsubstituted therewith, an aralkyl group having 7 to 10 carbon atoms, or a halogen atom, Ar represents a substituted or unsubstituted arylene group, D represents any one of structure represented by Formulas (VIII) to (XIII), c and s each represents 0 or 1, and t represents an integer in the range of 1 to 3.

Specifically, the Ar in the aryl group represented in Formula (7) is preferably the arylene group represented by Formula (8) or (9).

TABLE 2

| | |
|---|---|
| 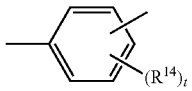 | (8) |
| 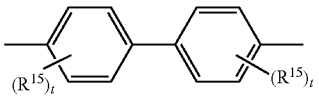 | (9) |

In Formulas (8) and (9), $R^{14}$ and $R^{15}$ each represents an hydrogen atom, an alkyl group having 1 to 4 carbon atoms, an alkoxy group having 1 to 4 carbon atoms, a phenyl group substituted with an alkoxy group having 1 to 4 carbon atoms or a unsubstituted phenyl group, an aralkyl group having 7 to 10 carbon atoms, or a halogen atom, and t represents an integer in the range of 1 to 3.

The Z' in the aryl group represented in Formula (7) is preferably a divalent group represented by Formulas (10) to (17).

TABLE 3

| | |
|---|---|
| $—(CH_2)_q—$ | (10) |
| $—(CH_2CH_2O)_r—$ | (11) |
| 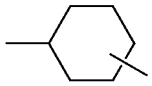 | (12) |
| 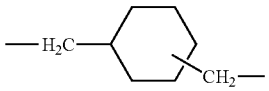 | (13) |
| 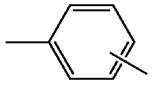 | (14) |
| 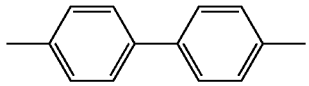 | (15) |
| 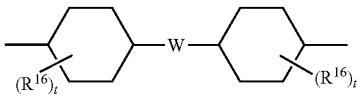 | (16) |
| 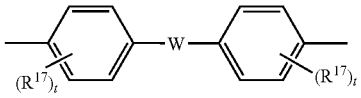 | (17) |

In Formulas (10) to (17), $R^{16}$ and $R^{17}$ each represents an hydrogen atom, an alkyl group having 1 to 4 carbon atoms, an alkoxy group having 1 to 4 carbon atoms, a phenyl group substituted with an alkoxy group having 1 to 4 carbon atoms or a unsubstituted phenyl group, an aralkyl group having 7 to 10 carbon atoms, or a halogen atom, W represents a divalent group, q and r each represents an integer in the range of 1 to 10, and t represents an integer in the range of 1 to 3.

In Formulas (16) and (17), W represents a divalent group represented by Formulas (18) to (26). u in Formula (25) represents an integer in the range of 0 to 3.

TABLE 4

| | |
|---|---|
| $—CH_2—$ | (18) |
| $—C(CH_3)_2—$ | (19) |
| —O— | (20) |
| —S— | (21) |
| $—C(CF_3)_2—$ | (22) |
| $—Si(CH_3)_2—$ | (23) |
| 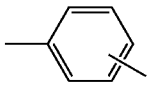 | (24) |
| 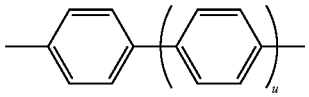 | (25) |
| 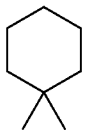 | (26) |

Specific examples of a structure of $Ar^5$ in Formula (VI) include a structure of c=1 in specific structures of $Ar^1$ to $Ar^4$ when k=0 and a structure of c=0 in specific structure of $Ar^1$ to $Ar^4$ when k=1.

These compounds may be used in admixture with other coupling agents and fluorine compounds for the purpose of adjusting film formabilities, flexibility, lubricanting abilities, and adhesions. As for these compounds, there may be used various silane coupling agents and commercially available silicone-based hard coating agents.

Examples of the silane coupling agents include vinyl trichlorosilane, vinyl trimethoxysilane, vinyl triethoxysilane, γ-glycidoxypropylmethyl diethoxysilane, γ-glycidoxypropylmethyl trimethoxysilane, γ-glycidoxypropylmethyl trimethoxysilane, γ-aminopropyl triethoxysilane, γ-aminopropyl trimethoxysilane, γ-aminopropylmethyl diemthoxysilane, N-β(aminoethyl)γ-aminopropyltriethoxysilane, tetramethoxysilane, methyl trimethoxysilane, and dimethyl dimethoxysilane. Examples of commercially available hard coating agents include KP-85, X-40-9740, X-40-2239 (produced by Shin-Etsu Silicone Co., Ltd.), AY42-440, AY42-441, and AY49-208 (produced by TORAY DOW CORNING CO., LTD.). The silane coupling agent may further comprise a fluorine-containing compound such as (tridecafluoro-1,1,2,2-tetrahydrooctyl)triethoxysilane, (3,3,3-trifluoropropyl)trimethoxysilane, 3-(heptafluoroisopropoxy) propyltriethoxysilane, 1H,1H,2H,2H-perfluoroalkyltriethoxysilane, 1H,1H,2H,2H-perfluorodecyltriethoxysilane and 1H,1H,2H,2H-perfluorooctyl triethoxysilane to give an water repellency. The silane coupling agent may be added in an arbitrary amount, but the amount of the fluorine-containing compound is preferably 0.25 times less than that of the fluorine-free compound. When the amount of the fluorine-containing compound exceeds such the range, problems in the film formabilities of the crosslinked layer are occasionally occurred.

The protective layer 117 may further comprise an alcohol soluble resin incorporated therein for the purpose of controlling discharge gas resistance, mechanical strength, scratch resistance, particle dispersibility, and viscosy, reducing torque, and prolonging pot life. Examples of the resin soluble in an alcohol solvent include polyvinyl butyral resin, polyvinyl formal resin, polyvinyl acetal resin such as partly acetalated polyvinyl acetal resin obtained by partly modifying butyral with formal, acetacetal or the like (for example, S-LEC B, K, produced by SEKISUI CHEMICAL CO., LTD.), polyamide resin, cellulose resin, and phenol resin. Particularly preferred among these resins is polyvinyl acetyl resin from the viewpoint of electrical properties. The average molecular weight of the resin is preferably in the range of 2,000 to 100,000, and more preferably in the range of 5,000 to 50,000. When the molecular weight of the resin is below 2,000, the effect obtained by adding the resin tends to be insufficient. On the contrary, when the molecular weight of the resin exceeds 100,000, solubility deteriorates so that the amount to be added is restricted, furthermore, defects in film thus formed are caused during coating. The content of the resin is preferably in the range of 1 to 40% by weight, more preferably in the range of 1 to 30% by weight, and further preferably in the range of 5 to 20% by weight. When the content of the resin is below 1% by weight, the effect obtained by adding the resin tends to be insufficient. On the contrary, when the content of the resin exceeds 40% by weight, image fog is easily generated under high temperature and humidity.

The coating solution for the protective layer containing these components can be prepared by using free of solvent or using alcohols such as methanol, ethanol, propanol, and butanol; ketones such as acetone and methyl ethyl ketone; or solvents such as tetrahydrofurane, diethyl ether, and dioxane. These solvents may be used alone or in combination of two or more thereof. Preferably, a solvent having a boiling point lower than 100° C. is used. The amount of the solvent may be arbitrarily setted. When the amount of the solvent is too small, the compounds represented by Formulas (I) to (VI) can easily be precipitated. Therefore, the amount of the solvent is in the range of 0.5 to 30 parts by weight, and preferably from 1 to 20 parts by weight, based on 1 part by weight of the compound represented by Formulas (I) to (VI).

The reaction temperature at which the aforementioned components are reacted to obtain the desired coating solution is not limited as long as it allows the blending and the dissolving, but preferably in the range of room temperature to 100° C., and more preferably in the range of 30° C. to 80° C., and the heating time is preferably 10 minutes to 100 hours, and more preferably 1 hour to 50 hours. In addition, the ultrasonic wave is preferably irradiated. Therefore, a partial reaction may be progressed, the coating solution is homogenously dispersed, and a homogenouse film having no coating defects can be obtained.

The protective layer 117 preferably includes an antioxidant for the purpose of preventing deterioration due to an oxidizing gas such as ozone gas generated in the charging device. When the prolonged lifetime of the photosensitive member is achieved by increasing the mechanical strength of the surface of the photosensitive member, the photosensitive member becomes to contact the oxidizing gas for the long period time. Therefore, strong antioxidant ability is required. The antioxidant is preferably a hindered phenol-based or a hindered amine-based, but it is also possible to employ a known antioxidant such as an organic sulfur-based antioxidant, a phosphite antioxidant, a dithiocarbamate antioxidant, a thiourea antioxidant, or a benzimidazole antioxidant. A content of the antioxidant is preferably 15 weight % or less, and more preferably 10 weight % or less.

Examples of the hindered phenol-based antioxidant include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzyl phosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenyl), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

In order to improve the stain resistance and lubricating properties of the surface of the photosensitive member, various fine particles can also be added to the protective layer 117. As one example of the fine particles, there may be exemplified by silicon-containing fine particles. The silicon-containing fine particles are fine particles containing silicon as a constituent element, and specifically, colloidal silica and silicone fine particles can be mentioned. The colloidal silica used as the silicon-containing fine particles is selected from acidic or alkaline aqueous dispersions having an average particle diameter of preferably 1 to 100 nm, and more preferably 10 to 30 nm or those dispersed in an organic solvent such as alcohol, ketone, and ester, and generally commercially available products can be used. The solids content of colloidal silica in the protective layer is not particularly limited, but is preferably 0.1 to 50 weight %, and more preferably 0.1 to 30 weight %, from the viewpoint of film formability, electrical characteristics, and strength.

The silicone fine particles used as the silicon-containing fine particles are selected from silicone resin particles, silicone rubber particles, and silicone surface-treated silica particles and generally commercially available products can be used. These silicone fine particles are spherical and have an average particle diameter of preferably 1 to 500 nm, and more preferably 10 to 100 nm. The silicone fine particles are chemically inert particles and have small diameter exhibiting excellent dispersibility in resin, and the content of the silicone fine particles required for further achieving sufficient characteristics is low, so that the surface state of the electrophotographic photosensitive member can be improved without inhibiting crosslinking reaction. That is, the silicone fine particles can incorporated uniformly into the rigid crosslinking structure and can simultaneously improve lubricating properties and water repellence of the surface of the electrophotographic photosensitive member and maintain excellent abrasion resistance and stain resistance for a long time. The content of the silicone fine particles in the protective layer is in the range of preferably 0.1 to 30 weight %, more preferably in the range of 0.5 to 10 weight %, based on the total solids content of the protective layer.

Examples of other fine particles include fluorine-based fine particles such as ethylene tetrafluoride, ethylene trifluoride, propylene hexafluoride, vinyl fluoride, and vinylidene fluoride; fine particles consisting of a resin having the fluorine resin copolymerized with a monomer having a hydroxyl group, for example fine particles shown in "Preliminary Collection of Eighth Polymer Material Forum Lectures, p. 89"; and semi-electroconductive metal oxides such as ZnO—$Al_2O_3$, $SnO_2$—$Sb_2O_3$, $In_2O_3$—$SnO_2$, ZnO—$Ti_2$, MgO—$Al_2O_3$, FeO—$TiO_2$, $TiO_2$, $SnO_2$, $In_2O_3$, ZnO, and MgO. For the same purpose, oils such as silicone oil can also be added. Examples of the silicone oil includes, silicone oils such as dimethyl polysiloxane, diphenyl polysiloxane, and phenyl methyl siloxane; reactive silicone oils such as amino-modified polysiloxane, epoxy-modified polysiloxane, carboxyl-modified polysiloxane, carbinol-modified polysiloxane, methacryl-modified polysiloxane, mercapto-modified polysiloxane, and phenol-modified polysiloxane; cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine-containing cyclosiloxanes such as 3-(3,3,3-trifluoropropyl)methylcyclotrisiloxane; hydrosilyl group-containing cyclosiloxanes such as methylhydrosiloxane mixture, pentamethylcyclopentasiloxane, and phenylhydrocyclosiloxane; and vinyl group-containing cyclosiloxanes such as pentavinylpentamethylcyclopentasiloxane.

The surface-treated metal oxides may be added to the protective layer 117. The known metal oxides may be used, but preferred are titanium oxide, aluminium oxide, tin oxide, and zinc oxide and particularly preferred is zinc oxide from the viewpoint of electric-conductivity. The metal oxides may include other components slightly doped therewith. For example, strontium-doped tin oxide, aluminium-doped zinc oxide, or the like may be used.

The fine particle resistance of the metal oxides is in the range of preferably 1 Ωcm to $1\times10^7$ Ωcm, more preferably 10 Ωcm to $1\times10^5$ Ωcm. When the fine particle resistance is less than 10 Ωcm, the resistance of the protective layer becomes excessively low and thus the image deletion is occurred under high temperature and high humidity. On the contrary, when it exceeds $1\times10^7$ Ωcm, the electricity characteristics deteriorate.

The average particle diameter of the metal oxides is preferably in the range of 10 nm to 100 nm, and more particularly 30 nm to 80 nm. When the average particle diameter is less than 10 nm, the surface area becomes excessively large, and thus the dispersability may deteriorate. When the average particle diameter exceeds 100 nm, the metal oxides, binder components, and the charge transporting agent components become irregular, and thus the transparency may be damaged.

The metal oxides are subjected to the surface treatment by using at least one of hydrolysis organic silicon compound having sulfonic acid, organic silicon compound having thiol group, and organic silicon compound having sulfide group.

The siloxane-based resin or phenol-based resin having the charge transporting characteristic and the crosslinking structure exhibits excellent mechanical strength and has sufficient photoelectric characteristics, and thus this resin may be used as the charge transporting layer of a laminate photosensitive member as it is. In this case, a known method such as a blade coating method, a Mayer bar coating method, a spray coating method, a dip coating method, a bead coating method, an air knife coating method, a curtain coating method, and the like may be used. When a required film thickness can not be obtained by one time of coating, coating process may be performed for several times to obtain the required film thickness. When the coating process is performed for several times, the heating process may be performed for every coating process, or performed after several coating processes are performed.

The charge generating/transporting layer 118 contains charge generating materials, charge transporting materials, and blinding resins. The components exemplified in description of the charge generating layer 115 and the charge transporting layer 116 may be used as these components. The content of the charge generating material in the charge generating/transporting layer 118 is in the range of 10 weight % to 85 weight %, and preferably in the range of 20 weight % to 50 weight %. The content of the charge transporting materials is preferably in the range of 5 weight % to 50 weight %. The charge generating/transporting layer 118 is preferably formed in the same manner as the charge transporting layer 116 or the charge transporting layer 116. The thickness of the charge generating/transporting layer 118 is preferably in the range of 5 to 50 μm, and more preferably 10 μm to 40 μm.

For the purpose of protecting a photosensitive member from ozone or oxidizing gases generated in a copying machine or heat and light, antioxidants, photostabilizers, or the like additives may be added to layers constituting the photosensitive layer 113 of the electrophotographic photosensitive member shown in FIGS. 4 and 5. Examples of the antioxidants include hindered phenols, hindered amines, paraphenylenediamine, arylalkane, hydroquinone, spirochroman, spiroindanone, derivatives of thereof, organic sulfur compounds, and organic phosphorus compounds. Examples of the photostabilizers include benzophenone, benzotriazole, dithiocarbamate, tetramethylpiperidine, and derivatives thereof. For the purpose of improving sensitivity, reducing a residual potential, and reducing fatigue from repeated use, one or more electron accepting substances may be incorporated into the photosensitive layer. Suitable examples of electron accepting substances which can be used in the present invention are succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among these, fluorenone-based compounds, quinine-based compounds, and benzene derivatives having an electron attracting substitute, such as Cl—, CN— or $NO_2$— are preferred.

When the protective layer 117 shown in FIGS. 4 and 5 is processed in the same manner as the blade member by using an aqueous dispersion solution containing fluorine-based resin, additional reduction in torque can be obtained and transfer efficiency can be improved, and thus it is preferable.

EXAMPLES

The invention will be described in greater detail with reference to the following Examples and Comparative Examples, but the invention is not be limited thereto.

[Production of Photosensitive Member 1]

100 parts by weight of zinc oxide (average particle diameter 70 nm; manufactured by Tayca Corp.; specific area value 15 $m^2/g$) is mixed with 500 parts by weight of tetrahydrofuran with stirring. Thereto is added 1.25 parts by weight of a silane coupling agent (trade name, KBM 403; manufactured by Shin-Etsu Chemical Co., Ltd.). The mixture is stirred for 2 hours. Thereafter, the toluene is removed by vacuum distillation and the resultant is baked at 120° C. for 3 hours, thereby obtaining the surface-treated zinc oxide pigment.

100 parts by weight of the surface-treated zinc oxide thus obtained is mixed with 500 parts by weight of tetrahydrofuran with stirring. Thereto is added a solution prepared by adding 1 part by weight of alizarin to 50 parts by weight of tetrahydrofuran and the mixture is stirred for 5 hours at 50° C. Thereafter, the alizarin-added zinc oxide is removed by vacuum distillation and the resultant is vacuum dried at 60° C., thereby obtaining the alizarin-added zinc oxide pigment.

60 parts by weight of the alizarin-added zinc oxide pigment is mixed with 13.5 parts by weight of a hardener (blocked isocyanate Sumidule 3175, manufactured by Sumitomo Bayer Urethane Co., Ltd.), 15 parts by weight of butyral resin (S-Lec BM-1 manufactured by Sekisui Chemical Co., Ltd.), and 85 parts by weight of methyl ethyl ketone. 38 parts by weight of the resultant liquid is mixed with 25 parts by weight of methyl ethyl ketone, and this mixture is subjected to a 2 hour dispersion treatment with a sand grinder mill using 1 mmΦ glass beads. Thus, a dispersion solution is obtained.

To the dispersion solution is added 0.005 parts by weight of dioctyl tin dilaurate and 40 parts by weight of silicon resin particles (tospearl 145, manufactured by GE Toshibal Silicones) serving as a catalyst and the mixture is hardened at 170° C. for 40 minutes under dry condition, thereby obtaining a undercoat coating solution. The coating solution is dip coated on an aluminium base material having a diameter of 30 mm, a length of 404 mm, and a thickness of 1 mm in a dip coating method, thereby forming a under coat layer having a thickness of 21 μm.

1 part by weight of chlorogallium phthalocyanine crystal having strong diffraction peaks at least 7.4°, 16.6°, 25.5°, and 28.3° of the Bragg angle (2θ±0.2) in the X-ray diffraction spectrum is mixed with 1 part by weight of a polyvinyl butyral resin (trade name: S-Lec BM-S, manufactured by Sekisui Chemical Co., Ltd.) and 100 parts by weight of butyl acetate, and the mixture is dispersed in a paint shaker together with glass beads for 1 hour. The coating solution thus obtained is dip coated on the surface of the undercoat layer and dried by heating at 100° C. for 10 minutes, thereby obtaining a charge generating layer having a thickness of approximately 0.15 μm.

1.75 parts by weight of a compound represented by the following formula (XVIII-1) and 3.25 parts by weight of a high molecular compound (viscosity average molecular weight: 39,000) represented by the following formula (XIX-1) are dissolved in 10 parts by weight of tetrahydrofuran and 5 parts by weight of toluene. The coating solution thus obtained is dip coated on the surface of the charge generating layer and dried by heating at 135° C. for 45 minutes, thereby obtaining 18 μm thick charge transporting layer. The photosensitive layer thus obtained is used as a photosensitive layer 1.

(XVIII-1)

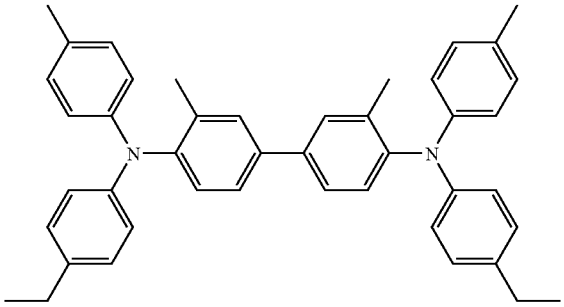

(XIX-1)

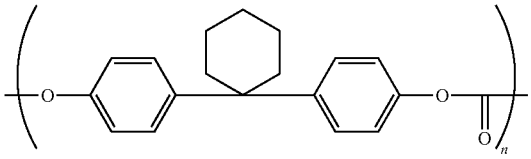

[Production of Photosensitive Member 2]

A photosensitive member 2 is produced in the same manner as the photosensitive member 1 until producing the charge transporting layer. Next, 4.5 parts by weight of a compound represented by the following formula (XVIII-2), 15 parts by weight of isopropyl alcohol, 9 parts by weight of tetrahydrofuran, and 0.9 parts by weight of distilled water are mixed and 0.5 part by weight of an ion-exchange resin (Amberlyst 15E) is added thereto. The mixture is stirred at room temperature to carry out hydrolysis. Subsequently, 0.5 part by weight of butylal resin, 5.5 parts by weight of resole type phenol resin (PL-2215; manufactured by Gun Ei Chemical Industry Co., Ltd.), and 0.05 part by weight of dimethyl polysiloxane are added thereto, thereby preparing a coating solution for forming a protective layer. The coating solution for forming the protective layer is dip coated on the charge transporting layer in a dip coating method and dried at 150° C. for 35 minutes, thereby forming a protective layer having a thickness of approximately 8 μm. The photosensitive member thus obtained is used as the photosensitive member 2.

(XVIII-2)

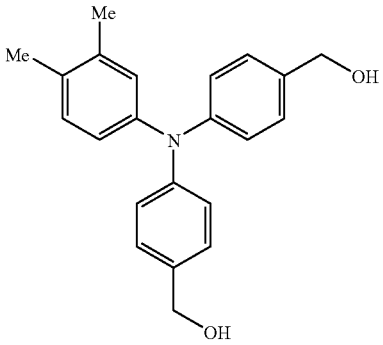

[Production of Photosensitive Member 3]

A photosensitive member 3 is produced in the same manner as the photosensitive member 1 until producing the charge transporting layer. Next, a protective layer is produced in the same manner as Example 1 except that a compound represented by the following formula (XVIII-3) is used instead of the compound represented by the formula (XVIII-2)

(XVIII-3)

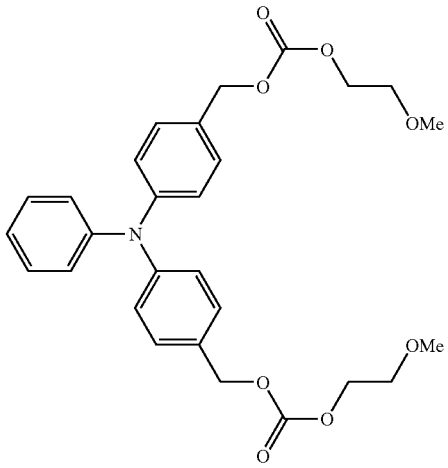

[Production of Photosensitive Member 4]

A photosensitive member 4 is produced in the same manner as the photosensitive member 1 until producing the charge transporting layer. Next, 2 parts by weight of a compound represented by the following formula (XVIII-4), 2 parts by weight of methyltrimethoxysilane, 0.5 part by weight of tetramethoxysilane, and 0.3 parts by weight of colloidal silica are dissolved in a mixture obtained by mixing 5 parts by weight of isopropyl alcohol, 3 parts by weight of tetrahydrofuran, and 0.3 part by weight of distilled water, and 0.5 part by weight of the ion-exchange resin (Amberlyst 15E; manufactured by Rohm & Haas Co., Ltd) is added thereto. The mixture is stirred at room temperature to carry out hydrolysis for 24 hours. Subsequently, the ion-exchange resin is filtered off from the reaction compound after the hydrolysis, and 0.1 part by weight of aluminum tris-acetylacetonate ($Al(aqaq)_3$) and 0.4 part by weight of 3,5-di-t-butyl-4-hydroxytoluene (BHT) are added to the filtrate. The coating solution thus obtained is coated on the charge transporting layer in a ring dip coating method, dried at room temperature for 30 minutes, and subjected to a heating process of 170° C. for 1 hour to harden the resultant. The photosensitive member obtained by forming a protective layer having a thickness of approximately 7 μm is used as the photosensitive member 4.

(XVIII-4)

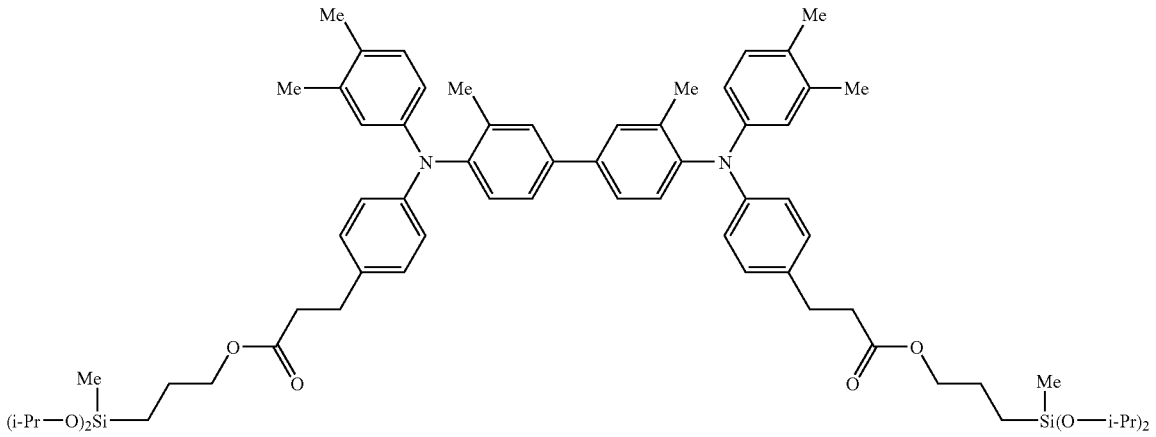

[Production of Image Forming Apparatus and an Image Forming Test]

Example 1

In Example 1, an image forming apparatus having a structure shown in FIG. 1 is produced by using the photosensitive member 2. The components other than the photosensitive member 2 are prepared in the same manner as DocuCentre Color a450 manufactured by Fuji Xerox Corp. The image forming apparatus in Example 1 includes a control section shown in FIG. 2 and performed a control process of a speed ratio ΔV according to a sequence of a flowchart shown in FIG. 3. The reference values of humidity and temperature are set to 50% RH and 22° C., respectively, and the reference value in the ablation estimating process is set to 15 nm in terms of film thickness (total rotations: 1,000 times of rotation) so that the speed ratio ΔV is controlled by changing from 3% to 0% as shown in Table 5.

Next, an image forming test is conducted for the image forming apparatus in Example 1 and an evaluation for an image quality thereof is conducted. The test conditions in Example 1 are fixed conditions of 28° C. and 85% RH. The image quality test is conducted by continuously forming A4 size paper having an image density of 5% and evaluating the image quality every total rotation described in Table 5 until the 100,000 rotations. The ablation amount per 100 times of rotation of the photosensitive member is obtained from a remained thickness of the outer most surface when the total rotation is 100,000 times. The image quality evaluation is conducted as follows.

A: good

B: very slight of image fog is generated. (it causes no problem in vision evaluation and is a level confirmable by using a magnifying glass)

C: image fog is generated. (Problems for the use) The results thus obtained are shown in Table 5.

Example 2

In example 2, an image forming apparatus having a structure shown in FIG. 1 is produced in the same manner as Example 1 by using the photosensitive member 2, except that the reference value in the ablation estimating process is set in 2 steps of 10.5 nm (total rotations: 700 times of rotation: a first reference) and 13 nm (total rotations: 2,000 times of rotation: a second reference) in terms of film thickness and the speed ratio ΔV is controlled by changing from 3% to 1% after the first reference, and changing from 1% to 0% after the second reference. The image forming apparatus thus produced is subjected to an image forming test and an image quality evaluation in the same manner as Example 1. The results thus obtained are shown in Table 5.

Comparative Example 1

In Comparative Example 1, an image forming apparatus having a structure shown in FIG. 1 is produced by using the photosensitive member 2. The components other than the photosensitive member 2 are produced in the same manner as DocuCentre Color a450 manufactured by Fuji Xerox Corp. The control of the speed ratio ΔV by the use of temperature, humidity, and the amount of abrasion is not performed and the speed ratio ΔV is fixed to 3%. Then, the evaluation is conducted in the same manner in Example 1. The results thus obtained are shown in Table 5.

Comparative Example 2

In Comparative Example 2, an image forming apparatus having a structure shown in FIG. 1 is produced by using the photosensitive member 2. The components other than the photosensitive member 2 are produced in the same manner as DocuCentre Color a450 manufactured by Fuji Xerox Corp. The control of the speed ratio ΔV by the use of temperature, humidity, and the amount of abrasion is not performed and the speed ratio ΔV is set as 1%. Then, the evaluation is conducted in the same manner in Example 1. The results thus obtained are shown in Table 5.

Comparative Example 3

In Comparative Example 3, an image forming apparatus having a structure shown in FIG. 1 is produced by using the photosensitive member 2. The components other than the photosensitive member 2 are produced in the same manner as DocuCentre Color a450 manufactured by Fuji Xerox Corp. The control of the speed ratio ΔV by the use of temperature, humidity, and the amount of abrasion is not performed and the speed ratio ΔV is set as 0%. Then, the evaluation is conducted in the same manner in Example 1. The results thus obtained are shown in Table 5.

Example 3

In example 3, an image forming apparatus having a structure shown in FIG. 1 is produced in the same manner as Example 1 by using the photosensitive member 2, except that the reference value in the ablation estimating process is set to 2.5 nm (total rotations: 500 times) in terms of film thickness, the evaluation conditions are 10° C. and 15% RH before 500 times of rotation, and the evaluation conditions are 28° C. and 85% RH after 501 times of rotation. The image forming apparatus thus produced is subjected to an image forming test and an image quality evaluation in the same manner as Example 1. The results thus obtained are shown in Table 5.

Comparative Example 4

In Comparative Example 4, an image forming apparatus having a structure shown in FIG. 1 is produced by using the photosensitive member 2. The components other than the photosensitive member 2 are produced in the same manner as DocuCentre Color a450 manufactured by Fuji Xerox Corp. The evaluation conditions are 10° C. and 15% RH before 500 times of rotation and the evaluation conditions are 28° C. and 85% RH after 501 times of rotation. The control of the speed ratio ΔV by the use of temperature, humidity, and the amount of abrasion is not performed and the speed ratio ΔV is fixed to 0%. Then, the evaluation is conducted in the same manner in Example 1. The results thus obtained are shown in Table 5.

Example 4

In example 4, an image forming apparatus having a structure shown in FIG. 1 is produced in the same manner as Example 1 by using the photosensitive member 3, except that the reference value in the ablation estimating process is set in 2 steps of 10 nm (total rotations: 500 times of rotation: a first reference) and 18 nm (total rotations: 1,500 times of rotation: a second reference) in terms of film thickness and the speed ratio ΔV is controlled by changing from 3% to 1% after the first reference, and changing from 1% to 0% after the second reference. The image forming apparatus thus produced is subjected to an image forming test and an image quality evaluation in the same manner as Example 1. The results thus obtained are shown in Table 5.

Comparative Example 5

In Comparative Example 5, an image forming apparatus having a structure shown in FIG. 1 is produced by using the photosensitive member 2. The components other than the photosensitive member 2 are produced in the same manner as DocuCentre Color a450 manufactured by Fuji Xerox Corp. The control of the speed ratio ΔV by the use of temperature, humidity, and the amount of abrasion is not performed and the speed ratio ΔV is set to 0%. Then, the evaluation is conducted in the same manner in Example 1. The results thus obtained are shown in Table 5.

Example 5

In example 5, an image forming apparatus having a structure shown in FIG. 1 is produced in the same manner as Example 1 by using the photosensitive member 4, except that the reference value in the ablation estimating process is set to 2.4 nm (total rotations: 400 times) in terms of film thickness and the speed ratio ΔV is controlled by changing from 1% to 0% after the reference value. The image forming apparatus thus produced is subjected to an image forming test and an image quality evaluation in the same manner as Example 1. The results thus obtained are shown in Table 5.

Comparative Example 6

In Comparative Example 6, an image forming apparatus having a structure shown in FIG. 1 is produced by using the photosensitive member 4. The components other than the photosensitive member 4 are produced in the same manner as DocuCentre Color a450 manufactured by Fuji Xerox Corp. The control of the speed ratio ΔV by the use of temperature, humidity, and the amount of abrasion is not performed and the speed ratio ΔV is set to 0%. Then, the evaluation is conducted in the same manner in Example 1. The results thus obtained are shown in Table 5.

Comparative Example 7

In Comparative Example 7, an image forming apparatus having a structure shown in FIG. 1 is produced by using the photosensitive member 1. The components other than the photosensitive member 1 are produced in the same manner as DocuCentre Color a450 manufactured by Fuji Xerox Corp. The control of the speed ratio ΔV by the use of temperature, humidity, and the amount of abrasion is not performed and the speed ratio ΔV is set to 0%. Then, the evaluation is conducted in the same manner in Example 1. The results thus obtained are shown in Table 5.

TABLE 5

| | | | | total number of rotations of photosensitive member (times) | | | | | | | | |
|---|---|---|---|---|---|---|---|---|---|---|---|---|
| | Photosensitive member | Test environment | | to 100 | to 200 | to 300 | to 400 | to 500 | to 600 | to 700 | to 800 | to 900 |
| Ex. 1 | Photosensitive member 2 | 28° C./85% RH | speed difference ΔV[%] | 3 | 3 | 3 | 3 | 3 | 3 | 3 | 3 | 3 |
| | | | image quality evaluation result | A | A | A | A | A | A | A | A | A |
| Ex. 2 | Photosensitive member 2 | 28° C./85% RH | speed difference | 3 | 3 | 3 | 3 | 3 | 3 | 3 | 1 | 1 |

TABLE 5-continued

| | | | | | | | | | | | | | |
|---|---|---|---|---|---|---|---|---|---|---|---|---|---|
| | | | ΔV[%] | | | | | | | | | | |
| | | | image quality evaluation result | A | A | A | A | A | A | A | A | A |
| Com. Ex. 1 | Photosensitive member 2 | 28° C./85% RH | speed difference ΔV[%] | 3 | 3 | 3 | 3 | 3 | 3 | 3 | 3 | 3 |
| | | | image quality evaluation result | A | A | A | A | A | A | A | A | A |
| Com. Ex. 2 | Photosensitive member 2 | 28° C./85% RH | speed difference ΔV[%] | 1 | 1 | 1 | 1 | 1 | 1 | 1 | 1 | 1 |
| | | | image quality evaluation result | C | C | B | B | B | B | B | A | A |
| Com. Ex. 3 | Photosensitive member 2 | 28° C./85% RH | speed difference ΔV[%] | 0 | 0 | 0 | 0 | 0 | 0 | 0 | 0 | 0 |
| | | | image quality evaluation result | C | C | C | C | C | C | C | B | B |
| Ex. 3 | Photosensitive member 2 | environment change | environment change | | 10° C./15% RH | | | | 28° C./85% RH | | | |
| | | | speed difference ΔV[%] | 0 | 0 | 0 | 0 | 0 | 1 | 1 | 1 | 1 |
| | | | image quality evaluation result | A | A | A | A | A | A | A | A | A |
| Com. Ex. 4 | Photosensitive member 2 | environment change | environment change | | 10° C./15% RH | | | | 28° C./85% RH | | | |
| | | | speed difference ΔV[%] | 0 | 0 | 0 | 0 | 0 | 0 | 0 | 0 | 0 |
| | | | image quality evaluation result | A | A | A | A | A | B | B | B | B |
| Ex. 4 | Photosensitive member 3 | 28° C./85% RH | speed difference ΔV[%] | 3 | 3 | 3 | 3 | 3 | 1 | 1 | 1 | 1 |
| | | | image quality evaluation result | A | A | A | A | A | A | A | A | A |
| Com. Ex. 5 | Photosensitive member 3 | 28° C./85% RH | speed difference ΔV[%] | 0 | 0 | 0 | 0 | 0 | 0 | 0 | 0 | 0 |
| | | | image quality evaluation result | C | C | C | C | C | B | B | B | B |
| Ex. 5 | Photosensitive member 4 | 28° C./85% RH | speed difference ΔV[%] | 1 | 1 | 1 | 1 | 0 | 0 | 0 | 0 | 0 |
| | | | image quality evaluation result | A | A | A | A | A | A | A | A | A |
| Com. Ex. 6 | Photosensitive member 4 | 28° C./85% RH | speed difference ΔV[%] | 0 | 0 | 0 | 0 | 0 | 0 | 0 | 0 | 0 |
| | | | image quality evaluation result | B | B | B | B | A | A | A | A | A |
| Com. Ex. 7 | Photosensitive member 1 | 28° C./85% RH | speed difference ΔV[%] | 0 | 0 | 0 | 0 | 0 | 0 | 0 | 0 | 0 |
| | | | image quality evaluation result | A | A | A | A | A | A | A | A | A |

| | | | | total number of rotations of photosensitive member (times) | | | | | | abrasion ratio per 1000 |
|---|---|---|---|---|---|---|---|---|---|---|
| | Photosensitive member | Test environment | | to 1000 | to 1500 | to 2000 | to 2500 | to 3000 | 3001 to 100000 | times of rotation |
| Ex. 1 | Photosensitive member 2 | 28° C./85% RH | speed difference ΔV[%] | 3 | 0 | 0 | 0 | 0 | 0 | 4 nm |

TABLE 5-continued

| | | | | | | | | | | |
|---|---|---|---|---|---|---|---|---|---|---|
| | | | image quality evaluation result | A | A | A | A | A | A | |
| Ex. 2 | Photosensitive member 2 | 28° C./85% RH | speed difference ΔV[%] | 1 | 1 | 1 | 0 | 0 | 0 | 3 nm |
| | | | image quality evaluation result | A | A | A | A | A | A | |
| Com. Ex. 1 | Photosensitive member 2 | 28° C./85% RH | speed difference ΔV[%] | 3 | 3 | 3 | 3 | 3 | 3 | 15 nm |
| | | | image quality evaluation result | A | A | A | A | A | A | |
| Com. Ex. 2 | Photosensitive member 2 | 28° C./85% RH | speed difference ΔV[%] | 1 | 1 | 1 | 1 | 1 | 1 | 6 nm |
| | | | image quality evaluation result | A | A | A | A | A | A | |
| Com. Ex. 3 | Photosensitive member 2 | 28° C./85% RH | speed difference ΔV[%] | 0 | 0 | 0 | 0 | 0 | 0 | 3 nm |
| | | | image quality evaluation result | B | B | B | A | A | A | |
| Ex. 3 | Photosensitive member 2 | environment change | environment change | 28° C./85% RH | | | | | | 5 nm |
| | | | speed difference ΔV[%] | 1 | 0 | 0 | 0 | 0 | 0 | |
| | | | image quality evaluation result | A | A | A | A | A | A | |
| Com. Ex. 4 | Photosensitive member 2 | environment change | environment change | 28° C./85% RH | | | | | | 5 nm |
| | | | speed difference ΔV[%] | 0 | 0 | 0 | 0 | 0 | 0 | |
| | | | image quality evaluation result | A | A | A | A | A | A | |
| Ex. 4 | Photosensitive member 3 | 28° C./85% RH | speed difference ΔV[%] | 1 | 1 | 0 | 0 | 0 | 0 | 4 nm |
| | | | image quality evaluation result | A | A | A | A | A | A | |
| Com. Ex. 5 | Photosensitive member 3 | 28° C./85% RH | speed difference ΔV[%] | 0 | 0 | 0 | 0 | 0 | 0 | 4 nm |
| | | | image quality evaluation result | B | B | A | A | A | A | |
| Ex. 5 | Photosensitive member 4 | 28° C./85% RH | speed difference ΔV[%] | 0 | 0 | 0 | 0 | 0 | 0 | 6 nm |
| | | | image quality evaluation result | A | A | A | A | A | A | |
| Com. Ex. 6 | Photosensitive member 4 | 28° C./85% RH | speed difference ΔV[%] | 0 | 0 | 0 | 0 | 0 | 0 | 6 nm |
| | | | image quality evaluation result | A | A | A | A | A | A | |
| Com. Ex. 7 | Photosensitive member 1 | 28° C./85% RH | speed difference ΔV[%] | 0 | 0 | 0 | 0 | 0 | 0 | 45 nm |
| | | | image quality evaluation result | A | A | A | A | A | A | |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus, comprising:

an intermediate transfer type image forming unit that primarily transfers a toner image formed on an electrophotographic photosensitive member to an intermediate transfer member and then secondarily transfers the toner image from the intermediate transfer member to a printing medium; and a control unit that controls a moving speed ratio ΔV represented by Expression 1 depending on a usage history of the electrophotographic photosensitive member, $$\Delta v[\%] = \frac{|v_2 - v_1|}{v_1} \times 100 \quad (1)$$

where $V_1$ is a moving speed [mm/s] of a surface of the electrophotographic photosensitive member; and $V_2$ is a moving speed [mm/s] of a surface of the intermediate transfer member in a moving direction of the surface of the electrophotographic photosensitive member, wherein the electrophotographic photosensitive member comprises a surface layer containing a curable resin on a surface facing to the intermediate transfer member, wherein the control unit controls the moving speed ratio ΔV by selecting one ΔV out of a plurality of ΔVs depending on the usage history of the electrophotographic photosensitive member.

2. The image forming apparatus according to claim 1, wherein the control unit controls the moving speed ratio ΔV to be 0 when at least one parameter reaches a predetermined value based on a correlation between: the at least one parameter selected from the group consisting of a total number of images formed in the image forming unit, a total number of rotations of the electrophotographic photosensitive member and a total number of printout sheets of the printing medium, which are previously acquired with respect to the electrophotographic photosensitive member; and an amount of abrasion of the outermost surface of the electrophotographic photosensitive member.

3. The image forming apparatus according to claim 1, wherein the control unit controls the moving speed ratio ΔV to be 0 when a total number of images formed in the image forming unit reaches a predetermined value based on a correlation between: the total number of images formed in the image forming unit, which is previously acquired with respect to the electrophotographic photosensitive member; and an amount of abrasion of the outermost surface of the electrophotographic photosensitive member.

4. The image forming apparatus according to claim 1, wherein the control unit controls the moving speed ratio ΔV to be 0 when a total number of rotations of the electrophotographic photosensitive member in the image forming unit reaches a predetermined value based on a correlation between: the total number of rotations of the electrophotographic photosensitive member in the image forming unit, which is previously acquired with respect to the electrophotographic photosensitive member; and an amount of abrasion of the outermost surface of the electrophotographic photosensitive member.

5. The image forming apparatus according to claim 1, wherein the control unit controls the moving speed ratio ΔV to be 0 when a total number of printout sheets of the printing medium in the image forming unit reaches a predetermined value based on a correlation between: the total number of printout sheets of the printing medium in the image forming unit, which is previously acquired with respect to the electrophotographic photosensitive member; and an amount of abrasion of the outermost surface of the electrophotographic photosensitive member.

6. The image forming apparatus according to claim 1, further comprising:

a detection unit that detects at least one of a temperature and a humidity, wherein the control unit controls the moving speed ratio ΔV depending on the usage history of the electrophotographic photosensitive member, when at least one of the temperature and the humidity detected by the detection unit exceeds a predetermined value.

7. The image forming apparatus according to claim 1, wherein the surface layer comprises a charge transporting compound.

8. The image forming apparatus according to claim 7, wherein the charge transporting compound comprises at least one compound selected from the group consisting of compounds represented by the following formulas (I), (II), (III), (IV), (V) and (VI):

$$F—[(X^1)_{n1}R^1—Z^1H]_{m1} \quad (I)$$

in the formula (I), F represents an organic group derived from a compound having electron hole transporting properties;

$R^1$ represents an alkylene group;

$Z^1$ represents an oxygen atom, a sulfur atom, NH or COO;

$X^1$ represents an oxygen atom or a sulfur atom;

m1 represents an integer in a range of 1 to 4; and n1 represents 0 or 1:

$$F—[(X^2)_{n2}—(R^2)_{n3}—(Z^2)_{n4}G]_{n5} \quad (II)$$

in the formula (II), F represents an organic group derived from a compound having electron hole transporting properties;

$X^2$ represents an oxygen atom or a sulfur atom;

$R^2$ represents an alkylene group;

$Z^2$ represents an oxygen atom, a sulfur atom, NH or COO;

G represents an epoxy group;

n2, n3 and n4 each independently represents 0 or 1; and n5 represents an integer in a range of 1 to 4:

$$F[\text{-}D\text{-}Si(R^3)_{(3-a)}Q_a]_b \quad (III)$$

in the formula (III), F represents an organic group having a b-valency derived from a compound having electron hole transporting properties;

D represents a divalent group;

$R^3$ represents a hydrogen atom, a substituted or unsubstituted alkyl group or a substituted or unsubstituted aryl group;

Q represents a hydrolytic group;

a represents an integer in a range of 1 to 3; and b represents an integer in a range of 1 to 4:

(IV)

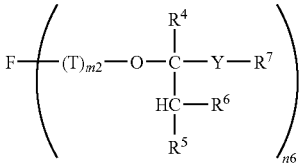

in the formula (IV), F represents an organic group derived from a compound having electron hole transporting properties;

T represents a divalent group;

Y represents an oxygen atom or a sulfur atom;

$R^4$, $R^5$ and $R^6$ each independently represents a hydrogen atom or a monovalent organic group;

$R^7$ represents a monovalent organic group;

m2 represents 0 or 1; and n6 represents an integer in a range of 1 to 4, provided that $R^6$ and $R^7$ may be bonded to form a heterocycle having Y as a hetero atom:

(V)

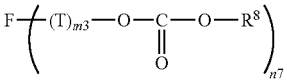

in the formula (V), F represents an organic group derived from a compound having electron hole transporting properties;

T represents a divalent group;

$R^8$ represents a monovalent organic group;

m3 represents 0 or 1; and n7 represents an integer in a range of 1 to 4:

(VI)

in the formula (VI), F represents an organic group derived from a compound having electron hole transporting properties;

L represents an alkylene group;

$R^9$ represents a monovalent organic group; and n8 represents an integer in a range of 1 to 4.

* * * * *